US008985976B2

(12) United States Patent
Takahashi et al.

(10) Patent No.: US 8,985,976 B2
(45) Date of Patent: Mar. 24, 2015

(54) TWO-STAGE ROTARY EXPANDER, EXPANDER-INTEGRATED COMPRESSOR, AND REFRIGERATION CYCLE APPARATUS

(75) Inventors: Yasufumi Takahashi, Osaka (JP); Atsuo Okaichi, Osaka (JP); Takeshi Ogata, Osaka (JP); Hidetoshi Taguchi, Osaka (JP); Takumi Hikichi, Shiga (JP); Masaru Matsui, Kyoto (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 1098 days.

(21) Appl. No.: 12/992,976

(22) PCT Filed: May 18, 2009

(86) PCT No.: PCT/JP2009/002179

§ 371 (c)(1), (2), (4) Date: Nov. 16, 2010

(87) PCT Pub. No.: WO2009/141993

PCT Pub. Date: Nov. 26, 2009

(65) Prior Publication Data

US 2011/0070115 A1 Mar. 24, 2011

(30) Foreign Application Priority Data

May 19, 2008 (JP) ..... 2008-131360
May 19, 2008 (JP) ..... 2008-131361

(51) Int. Cl.

| | |
|---|---|
| ***F04C 14/18*** | (2006.01) |
| ***F01C 1/00*** | (2006.01) |
| ***F01C 1/02*** | (2006.01) |
| ***F04C 18/356*** | (2006.01) |
| ***F04C 23/00*** | (2006.01) |
| ***F01C 21/08*** | (2006.01) |
| ***F04C 18/02*** | (2006.01) |
| ***F25B 1/04*** | (2006.01) |
| ***F25B 9/00*** | (2006.01) |
| ***F25B 9/06*** | (2006.01) |

(52) U.S. Cl.

CPC ..... *F04C 23/006* (2013.01); *F01C 21/0827* (2013.01); *F04C 18/0215* (2013.01);

(Continued)

(58) Field of Classification Search

CPC ..... F01C 21/002; F01C 21/0809; F04C 18/3562; F04C 18/0215

USPC ..... 418/93, 259, 267, 268, 16, 22, 24, 25, 418/26, 248, 54, 23

See application file for complete search history.

(56) References Cited

U.S. PATENT DOCUMENTS 4,397,618 A * 8/1983 Stenzel ..... 418/23
5,616,019 A * 4/1997 Hattori et al. ..... 418/66

(Continued)

FOREIGN PATENT DOCUMENTS

JP 10-047285 2/1998
JP 2001-116371 4/2001

(Continued)

*Primary Examiner* — Mary A Davis
*Assistant Examiner* — Anthony Ayala Delgado
(74) *Attorney, Agent, or Firm* — Hamre, Schumann, Mueller & Larson, P.C.

(57) ABSTRACT

An expander-integrated compressor (100) includes: a compression mechanism (2) for compressing a working fluid; an expansion mechanism (3) for expanding a working fluid; and a shaft (5) that couples the compression mechanism (2) and the expansion mechanism (3). The expansion mechanism (3) includes a variable vane mechanism (60). The variable vane mechanism (60) controls the movement of a first vane (48) so that the ratio of a period $P_2$ to a period $P_1$ ($P_2/P_1$) can be adjusted, where $P_1$ denotes the period during which the first vane (48) is in contact with a first piston (46) in the course of one rotation of the shaft (5), and $P_2$ denotes the period during which the first vane (48) is spaced from the first piston (46) in the course of one rotation of the shaft (5).

19 Claims, 24 Drawing Sheets

(52) U.S. Cl.
CPC ..... *F04C18/3562* (2013.01); *F04C 23/008* (2013.01); *F25B 1/04* (2013.01); *F25B 9/008* (2013.01); *F25B 9/06* (2013.01); *F25B 2400/14* (2013.01); *F01C 21/0854* (2013.01)
USPC ..... 418/23; 418/22; 418/24; 418/25; 418/26; 418/248; 418/93

(56) References Cited

U.S. PATENT DOCUMENTS

| | | | | |
|---|---|---|---|---|
| 5,678,657 | A | 10/1997 | Lee | |
| 6,716,007 | B2 * | 4/2004 | Kim et al. | 418/23 |
| 6,796,773 | B1 * | 9/2004 | Choi et al. | 417/218 |
| 7,585,163 | B2 * | 9/2009 | Nishikawa et al. | 418/60 |
| 7,798,791 | B2 * | 9/2010 | Byun et al. | 418/26 |
| 2004/0131490 | A1 * | 7/2004 | Choi et al. | 418/23 |
| 2008/0310983 | A1 | 12/2008 | Sakitani et al. | |
| 2009/0139262 | A1 | 6/2009 | Takahashi et al. | |

FOREIGN PATENT DOCUMENTS

| | | |
|---|---|---|
| JP | 2006-046257 | 2/2006 |
| JP | 2006-348773 | 12/2006 |
| JP | 2007-009755 | 1/2007 |
| JP | 2007146663 A * | 6/2007 |
| JP | 2008-106668 | 5/2008 |
| WO | 2007/132649 | 11/2007 |

* cited by examiner

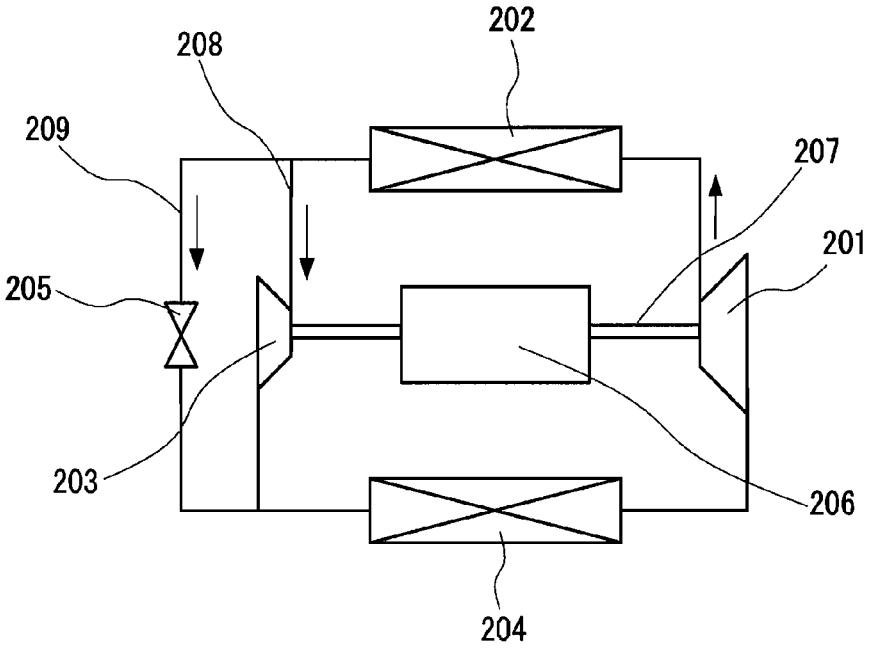
FIG.28 - Prior Art -
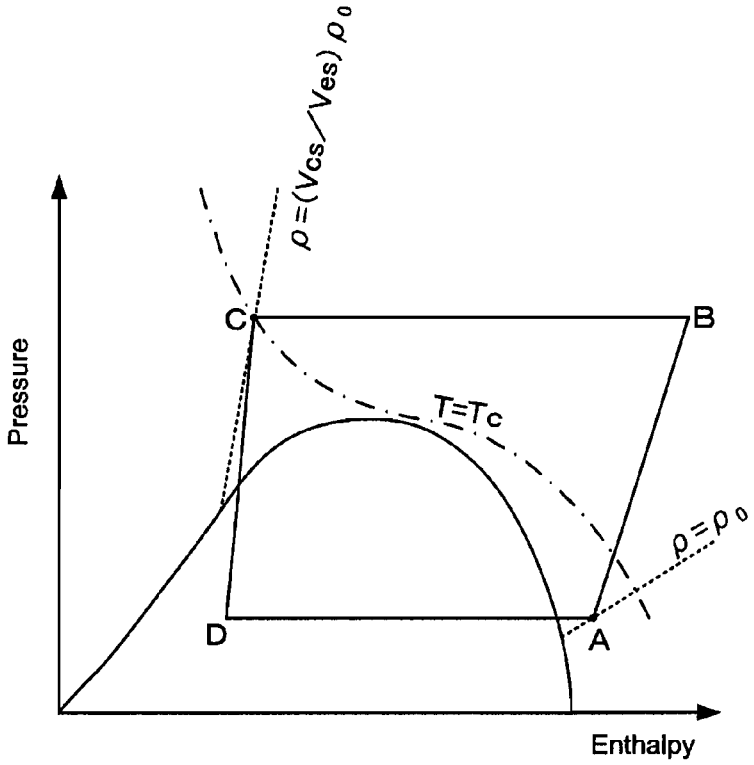
FIG.29 - Prior Art -

TWO-STAGE ROTARY EXPANDER, EXPANDER-INTEGRATED COMPRESSOR, AND REFRIGERATION CYCLE APPARATUS

TECHNICAL FIELD

The present invention relates to a two-stage rotary expander, an expander-integrated compressor, and a refrigeration cycle apparatus.

BACKGROUND ART

There have been proposed refrigeration cycle apparatuses in which an expander recovers the expansion energy of a working fluid, and the recovered energy is used for a part of the work of the compressor. As one of such refrigeration cycle apparatuses, a refrigeration cycle apparatus using an expander-integrated compressor is known (see Patent Literature 1).

FIG. 28 shows a conventional refrigeration cycle apparatus using an expander-integrated compressor. This refrigeration cycle apparatus includes a compressor (compression mechanism) 201, a radiator 202, an expander (expansion mechanism) 203, and an evaporator 204. These components are connected to each other by pipes so as to form a main circuit 208. The compressor 201 and the expander 203 are coupled together by a shaft 207. A motor 206 for rotationally driving the shaft 207 is disposed between the compressor 201 and the expander 203. The compressor 201, the expander 203, the shaft 207, and the motor 206 constitute the expander-integrated compressor.

This refrigeration cycle apparatus further includes a secondary circuit 209 that is connected to the main circuit 208 so as to be provided in parallel to the expander 203. The secondary circuit 209 branches from the main circuit 208 between the outlet of the radiator 202 and the inlet of the expander 203, and merges with the main circuit 208 between the outlet of the expander 203 and the inlet of the evaporator 204. A working fluid flowing through the main circuit 208 expands in the positive-displacement expander 203. The working fluid flowing through the secondary circuit 209 expands in an expansion valve 205.

The working fluid is compressed by the compressor 201. The compressed working fluid is delivered to the radiator 2, and cooled in the radiator 202. The working fluid expands in the expander 203 or the expansion valve 205, and then is heated in the evaporator 204. The expander 203 recovers the expansion energy of the working fluid, and converts the recovered energy into the rotational energy of the shaft 207. This rotational energy is used as part of the work for driving the compressor 201. As a result, the power consumption of the motor 206 is reduced.

How the refrigeration cycle apparatus operates when the expansion valve 205 is fully closed will be described.

First, the suction volume of the compressor 201, the suction volume of the expander 203, the rotational speed of the shaft 207 are denoted as Vcs, Ves, and N, respectively. In this case, the volumetric flow rate of the working fluid at the inlet of the compressor 201 is expressed as (Vcs×N). The volumetric flow rate of the working fluid at the inlet of the expander 203 is expressed as (Ves×N). Since the mass flow rate of the working fluid in the secondary circuit 209 is zero, the mass flow rate thereof in the compressor 201 and that in the expander 203 are equal to each other. If this mass flow rate is denoted as G, the density of the working fluid at the inlet of the compressor 201 is expressed as {G/(Vcs×N)}. The density of the working fluid at the inlet of the expander 203 is expressed as {G/(Ves×N)}. Based on these formulas, the ratio between the density of the working fluid at the inlet of the compressor 201 and that at the inlet of the expander 203 is expressed as {G/(Vcs×N)}/{G/(Ves×N)}. That is, the density ratio (Ves/Vcs) is always constant regardless of the rotational speed of the shaft 207 (constraint of constant density ratio).

FIG. 29 shows a Mollier diagram of a $CO_2$ refrigeration cycle. The compression process in the compressor 201, the heat radiation process in the radiator 202, the expansion process in the expander 203, and the evaporation process in the evaporator 204 correspond to AB, BC, CD, and DA, respectively. The ratio between the density of the working fluid at the inlet of the compressor 201 (Point A) and that at the inlet of the expander 203 (Point C) is (Ves/Vcs). If the density at Point A is $\rho_0$, the density $\rho_c$ at Point C is (Vcs/Ves)$\rho_0$. When the density $\rho_0$ of the working fluid at the inlet of the compressor 201 (Point A) is constant, the state of the working fluid at the inlet of the expander 203 (Point C) always changes along the line that satisfies the relationship of $\rho_c$=(Vcs/Ves)$\rho_0$. That is, the temperature and pressure of the working fluid at Point C cannot be controlled freely. The refrigeration cycle has an optimum high pressure at which the highest coefficient of performance (COP) is achieved at a certain heat source temperature (for example, an outside air temperature). Therefore, if the temperature and pressure cannot be controlled freely, it is difficult to operate the refrigeration cycle apparatus efficiently.

There have been several proposals to avoid the constraint of constant density ratio. For example, in the refrigeration cycle apparatus shown in FIG. 28, the constraint of constant density ratio can be avoided by opening the expansion valve 205 to allow a part of the working fluid to flow into the secondary circuit 209. This method, however, has a problem in that the expansion energy of the working fluid flowing through the secondary circuit 209 cannot be recovered, which reduces the effect of improving the COP.

Patent Literature 2 discloses an expander including an auxiliary chamber that can communicate with an expansion chamber. With this expander, the volumetric capacity of the expansion chamber can be increased or decreased by increasing or decreasing the volumetric capacity of the auxiliary chamber. The suction volume of the expander Ves changes with an increase or a decrease in the volumetric capacity of the expansion chamber. Thus, the constraint of constant density ratio can be avoided. Nevertheless, this expander has a problem in that the working fluid remains in the auxiliary chamber. It also has another problem of sealing a piston for increasing or decreasing the volumetric capacity of the auxiliary chamber.

CITATION LIST

Patent Literature

Patent Literature 1 JP 2001-116371 A
Patent Literature 2 JP 2006-46257 A

SUMMARY OF INVENTION

Technical Problem

The present invention has been made in view of the above circumstances, and it is an object of the present invention to provide a two-stage rotary expander in which both the avoidance of the constraint of constant density ratio and the efficient power recovery can be achieved. It is another object of the present invention to provide an expander-integrated compressor using this two-stage rotary expander. It is still another object of the present invention to provide a refrigeration cycle apparatus using this expander-integrated compressor.

Solution to Problem

The present invention provides a two-stage rotary expander including: a first cylinder; a first piston disposed rotatably in the first cylinder; a second cylinder disposed concentrically with the first cylinder; a second piston disposed rotatably in the second cylinder; a shaft on which the first piston and the second piston are mounted; a first vane, disposed slidably in a first vane groove formed in the first cylinder, for partitioning a space between the first cylinder and the first piston into a first suction space and a first discharge space; a second vane, disposed slidably in a second vane groove formed in the second cylinder, for partitioning a space between the second cylinder and the second piston into a second suction space and a second discharge space; an intermediate plate for separating the first cylinder from the second cylinder, the intermediate plate having a through-hole that communicates the first discharge space with the second suction space so as to form one expansion chamber; and a variable vane mechanism for controlling movement of the first vane so that a ratio of a period $P_2$ to a period $P_1$ ($P_2/P_1$) can be adjusted, where $P_1$ denotes the period during which the first vane is in contact with the first piston in the course of one rotation of the shaft, and $P_2$ denotes the period during which the first vane is spaced from the first piston in the course of one rotation of the shaft.

In another aspect, the present invention provides an expander-integrated compressor including: a compression mechanism for compressing a working fluid; an expansion mechanism for expanding the working fluid; and a shaft that couples the compression mechanism and the compression mechanism. In this expander-integrated compressor, the expansion mechanism is constituted by the above-mentioned two-stage rotary expander of the present invention.

In still another aspect, the present invention provides a refrigeration cycle apparatus including: the above-mentioned expander-integrated compressor of the present invention; a radiator for cooling a working fluid that has been compressed in a compression mechanism of the expander-integrated compressor; and an evaporator for evaporating a working fluid that has been expanded in an expansion mechanism of the expander-integrated compressor.

Advantageous Effects of Invention

The two-stage rotary expander of the present invention includes a variable vane mechanism for controlling the movement of the first vane. By the action of the variable vane mechanism, the first vane is spaced from the first piston during the period $P_2$, which is a part of the period of one rotation of the shaft, so that the working fluid in the first suction space can flow directly into the first discharge space. When the ratio ($P_2/P_1$) changes under the control of the movement of the first vane, the suction volume (volumetric flow rate) of the expansion mechanism also changes. That is, the constraint of constant density ratio can be avoided. In addition, since the power can be recovered from the entire amount of the working fluid, a high power recovery efficiency can be achieved.

Here, the minimum value of the period $P_2$ may be zero. When the period $P_2$ is zero, the first vane and the first piston are in contact with each other all the time, and thus the suction volume of the two-stage rotary expander is minimized. More specifically, the variable vane mechanism controls the movement of the first vane so that one of the following (a) and (b) is achieved.

(a) The variable vane mechanism controls the movement of the first vane so that a first mode and a second mode can be switched to each other. In the first mode, the first vane is always in contact with the first piston, and in the second mode, the period of one rotation of the shaft includes the period $P_1$ during which the first vane is in contact with the first piston and the period $P_2$ during which the first vane is spaced from the first piston.

(b) The variable vane mechanism controls the movement of the first vane so that the period of one rotation of the shaft includes the period $P_1$ during which the first vane is in contact with the first piston and the period $P_2$ during which the first vane is spaced from the first piston, and that the ratio of the period $P_2$ to the period $P_1$ ($P_2/P_1$) can be adjusted.

The two-stage rotary expander of the present invention can be used suitably as an expansion mechanism of an expander-integrated compressor in which it is difficult to control the rotational speed of the compression mechanism and the rotational speed of the expansion mechanism independently. In the refrigeration cycle apparatus using such an expander-integrated compressor, power can be recovered efficiently by controlling the variable vane mechanism properly. Accordingly, a high COP can be achieved.

BRIEF DESCRIPTION OF DRAWINGS

FIG. 28 is a configuration diagram showing a conventional refrigeration cycle apparatus using an expander-integrated compressor.

FIG. 29 is a Mollier diagram of a $CO_2$ refrigeration cycle.

DESCRIPTION OF EMBODIMENTS

Hereinafter, some of the embodiments of the present invention will be described with reference to the drawings.

(First Embodiment)

Figure 1:
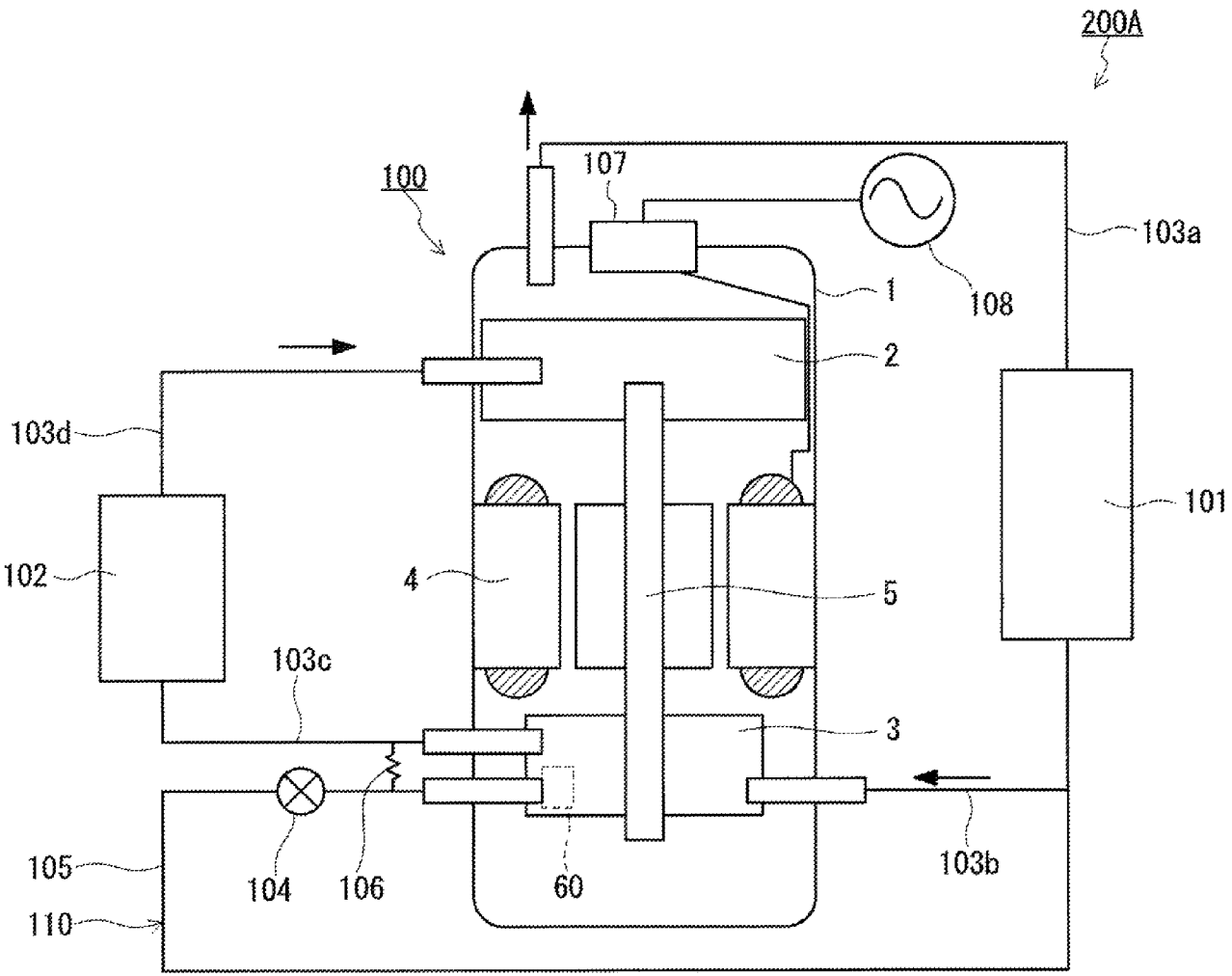
FIG. 1 is a configuration diagram showing a refrigeration cycle apparatus according to a first embodiment of the present invention.

As shown in FIG. 1, a refrigeration cycle apparatus 200A of the present embodiment includes a compression mechanism 2, a radiator 101, an expansion mechanism 3, an evaporator 102, and a plurality of pipes 103*a* to 103*d* for connecting these components to each other so as to form a refrigerant circuit. The compression mechanism 2 and the expansion mechanism 3 are coupled together by a shaft 5 so as to constitute an expander-integrated compressor 100. The basic operation of the refrigeration cycle apparatus 200A is as described in the background art.

The expansion mechanism 3 of the expander-integrated compressor 100 is provided with a variable vane mechanism 60. The variable vane mechanism 60 has a function of changing the volume (volumetric flow rate) of a working fluid to be drawn into the expansion mechanism 3 during one rotation of the shaft 5. In other words, it has a function of changing the suction volume of the expansion mechanism 3. The constraint of constant density ratio can be avoided by changing the volumetric flow rate of the expansion mechanism 3 according to the operation state of the refrigeration cycle apparatus 200A.

In the present embodiment, a method of injecting a high-pressure working fluid into the expansion chamber is employed as a method of changing the volumetric flow rate of the expansion mechanism 3. That is, the variable vane mechanism 60 can be a mechanism for injecting the working fluid into the expansion chamber.

The refrigeration cycle apparatus 200A further includes a pressure supply circuit 110 for driving the actuator of the variable vane mechanism 60. It should be noted, however, that in the present embodiment, this pressure supply circuit 110 is not a supply circuit for the working fluid to be injected into the expansion chamber. The pressure supply circuit 110 includes a throttle valve 104, a pipe 105 and a fine passage 106. The working fluid, whose pressure is adjusted to a predetermined one by the pressure supply circuit 110, is supplied to the variable vane mechanism 60.

The pipe 105 has one end connected to a portion (pipe 103*b*) between the radiator 101 and the expansion mechanism 3 in the refrigerant circuit, and the other end connected to the variable vane mechanism 60 of the expansion mechanism 3. The throttle valve 104 is an opening-adjustable valve (for example, an electric expansion valve), and is provided on the pipe 105. The portion between the throttle valve 104 and the variable vane mechanism 60 in the pipe 105 and the portion (pipe 103*c*) from the outlet of the expansion mechanism 3 to the inlet of the evaporator 102 in the refrigerant circuit are connected by the fine passage 106. A specific example of the fine passage 106 is a capillary.

Figure 2:
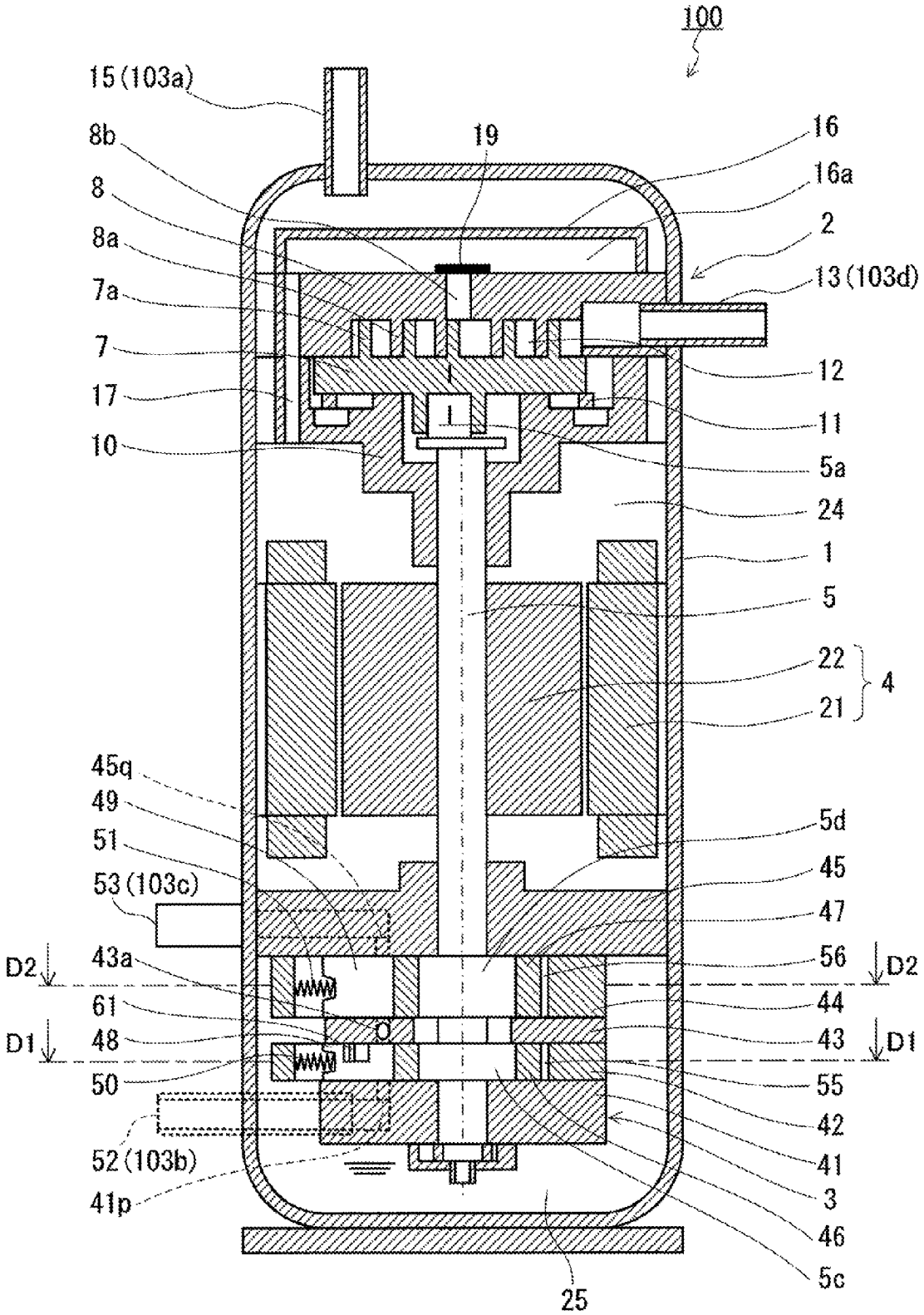
FIG. 2 is a longitudinal cross-sectional view of an expander-integrated compressor shown in FIG. 1.

As shown in FIG. 2, the expander-integrated compressor 100 includes a closed casing 1, the compression mechanism 2, the expansion mechanism 3, a motor 4, and the shaft 5. The compression mechanism 2 is disposed in the upper part in the closed casing 1. The expansion mechanism 3 is disposed in the lower part in the closed casing 1. The motor 4 is disposed between the compression mechanism 2 and the expansion mechanism 3. The compression mechanism 2, the motor 4, and the expansion mechanism 3 are coupled together by the shaft 5 so as to transmit power therebetween.

The compression mechanism 2 is actuated when the motor 4 drives the shaft 5. The expansion mechanism 3 recovers the power from the expanding working fluid and provides the recovered power to the shaft 5 so as to assist the motor 4 in driving the shaft 5. Specific examples of the working fluid include refrigerants such as carbon dioxide and hydrofluorocarbon.

In the present embodiment, the positions of the compression mechanism 2, the motor 4, and the expansion mechanism 3 are determined so that the axial direction of the shaft 5 coincides with the vertical direction. This positional relationship between the compression mechanism 2 and the expansion mechanism 3 in the present embodiment may be reversed. That is, the compression mechanism 2 may be disposed in the lower part in the closed casing 1, and the expansion mechanism 3 may be disposed in the upper part in the closed casing 1.

The closed casing 1 has an interior space 24 for accommodating the components. The interior space 24 of the closed casing 1 is filled with the working fluid that has been compressed in the compression mechanism 2. The bottom of the closed casing 1 is used as an oil reservoir 25. Oil is used to ensure the lubrication and sealing of the sliding parts in the compression mechanism 2 and the expansion mechanism 3. The amount of oil in the oil reservoir 25 is regulated so that the oil level is maintained below the motor 4. Therefore, it is possible to prevent the rotor of the motor 4 from agitating the oil and thus prevent a decrease in the motor efficiency and an increase in the amount of oil discharged into the refrigerant circuit.

The scroll compression mechanism 2 includes an orbiting scroll 7, a stationary scroll 8, an Oldham ring 11, a bearing member 10, a muffler 16, a suction pipe 13, a discharge pipe 15, and a reed valve 19. The bearing member 10 is fixed to the closed casing 1 by a technique, such as welding or shrink fitting, to support the shaft 5. The stationary scroll 8 is fixed to the bearing member 10 by a fastening member such as a bolt. The orbiting scroll 7 is fitted to the eccentric axis 5*a* of the shaft 5 between the stationary scroll 8 and the bearing member 10, and is prevented by the Oldham ring 11 from rotating on its own axis.

The orbiting scroll 7, with its spiral wrap 7*a* meshing with the wrap 8*a* of the stationary scroll 8, moves in an orbit as the shaft 5 rotates. A crescent-shaped working chamber 12 formed between the wrap 7*a* and the wrap 8*a* decreases its volumetric capacity as it moves inwardly, and compresses the working fluid drawn through the suction pipe 13. The compressed working fluid pushes open the reed valve 19 to be discharged into the interior space 16*a* of the muffler 16 through a discharge hole 8*b* formed in the center of the stationary scroll 8. The working fluid further is discharged into the interior space 24 of the closed casing 1 through a flow path 17 penetrating the stationary scroll 8 and the bearing member 10. Then, the working fluid is delivered to the radiator 101 through the discharge pipe 15.

The compression mechanism 2 may be constituted by another type of positive displacement compression mechanism (for example, a rotary compression mechanism).

The motor 4 includes a stator 21 fixed to the closed casing 1 and a rotor 22 fixed to the shaft 5. Electric power is supplied from a power source 108 to the motor 4 through a terminal 107 provided above the closed casing 1 (see FIG. 1).

The shaft 5 may be made up of a single part, or may be made up of a combination (coupling) of a plurality of parts. If the shaft 5 is made up of a combination of a plurality of parts, the assembly is easy, and in particular, the alignment of the compression mechanism 2 and the expansion mechanism 3 is easy.

Figure 3A:
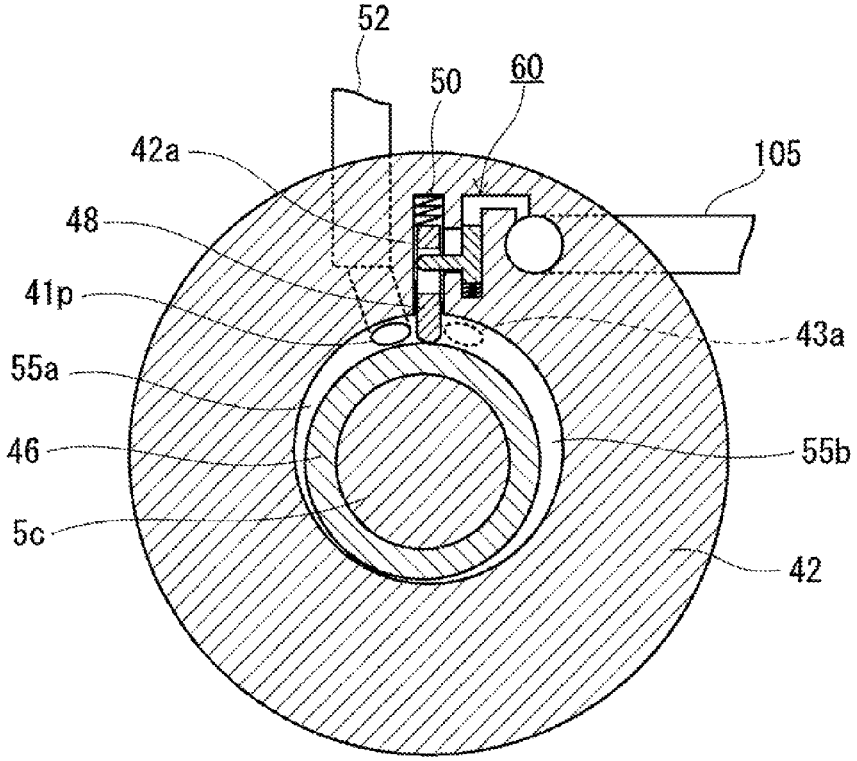
FIG. 3A is a transverse cross-sectional view of the expander-integrated compressor shown in FIG. 2, taken along the line D1-D1.
Figure 3B:
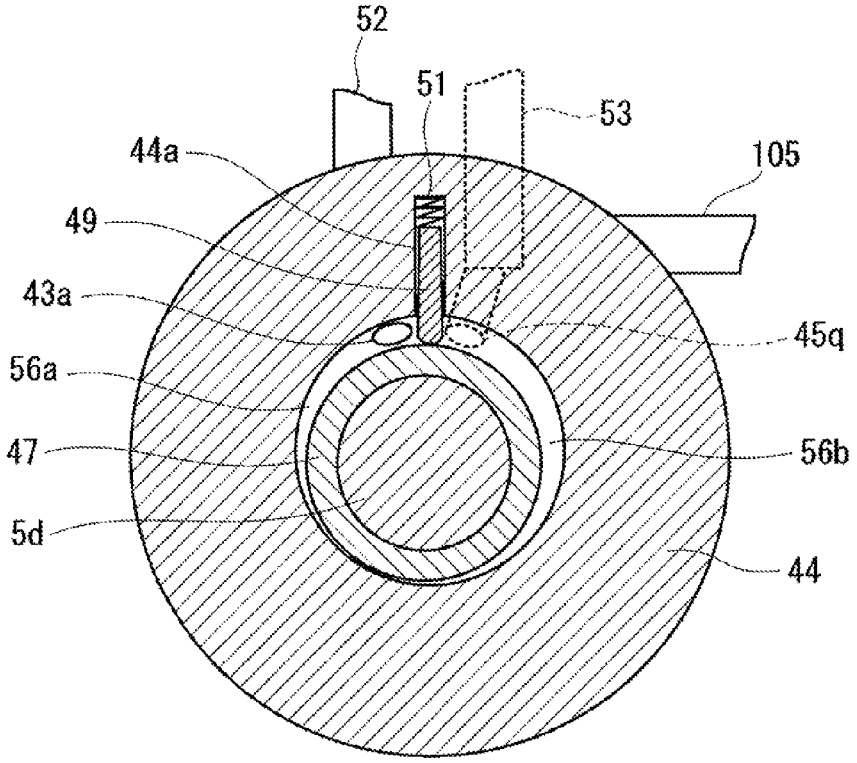
FIG. 3B is a transverse cross-sectional view of the expander-integrated compressor shown in FIG. 2, taken along the line D2-D2.

The expansion mechanism 3 has a structure of a multi-stage rotary expander. Specifically, the expansion mechanism 3 includes a first cylinder 42, a second cylinder 44 with a greater thickness than the first cylinder 42, and an intermediate plate 43 for separating the first cylinder 42 from the second cylinder 44. The first cylinder 42 and the second cylinder 44 are disposed concentrically with each other. As shown in FIG. 3A and FIG. 3B, the expansion mechanism 3 further includes a first piston (first roller) 46, a first vane 48, a first spring 50, a second piston (second roller) 47, a second vane 49, and a second spring 51. The first cylinder 42 has the variable vane mechanism 60 built therein.

As shown in FIG. 3A, the first piston 46 is fitted to the eccentric portion 5*c* of the shaft 5 so as to rotate eccentrically in the first cylinder 42. The first vane 48 is provided slidably in a first vane groove 42*a* formed in the first cylinder 42. One end (tip) of the first vane 48 is in contact with the first piston 46. The first spring 50 is in contact with the other end (rear end) of the first vane 48 and pushes the first vane 48 toward the first piston 46.

As shown in FIG. 3B, the second piston 47 is fitted to the eccentric portion 5*d* of the shaft 5 so as to rotate eccentrically in the second cylinder 44. The second vane 49 is provided slidably in a second vane groove 44*a* formed in the second cylinder 44. One end of the second vane 49 is in contact with the second piston 47. The second spring 51 is in contact with the other end of the second vane 49 and pushes the second vane 49 toward the second piston 47.

As shown in FIG. 2, the expansion mechanism 3 further includes a lower bearing member 41 and an upper bearing member 45. The upper bearing member 45 is fitted in the closed casing 1 with no space therebetween. The components such as the cylinders and the intermediate plate are fixed to the closed casing 1 by the upper bearing member 45. The lower bearing member 41 and the intermediate plate 43 close the first cylinder 42 from below and above respectively. The intermediate plate 43 and the upper bearing member 45 close the second cylinder 44 from below and above respectively. As a result, a working chamber is formed in each of the first cylinder 42 and the second cylinder 44. A suction port 42*p* for drawing the working fluid into the working chamber of the first cylinder 42 is formed in the lower bearing member 41. A discharge port 45*q* for discharging the working fluid from the working chamber of the second cylinder 44 is formed in the upper bearing member 45.

As shown in FIG. 3A, a suction-side working chamber 55*a* and a discharge-side working chamber 55*b* are formed in a space inside the first cylinder 42. The working chamber 55*a* and the working chamber 55*b* are partitioned by the first piston 46 and the first vane 48. As shown in FIG. 3B, a suction-side working chamber 56*a* and a discharge-side working chamber 56*b* are formed in a space inside the second cylinder 44. The working chamber 56*a* and the working chamber 56*b* are partitioned by the second piston 47 and the second vane 49. Hereinafter, the working chambers 55*a*, 55*b*, 56*a*, and 56*b* are also referred to as a first suction space 55*a*, a first discharge space 55*b*, a second suction space 56*a*, and a second discharge 56*b*, respectively The total volumetric capacity of the working chamber 56*a* and the working chamber 56*b* in the second cylinder 44 is greater than that of the working chamber 55*a* and the working chamber 55*b* in the first cylinder 42. The discharge side working chamber 55*b* in the first cylinder 42 and the suction-side working chamber 56*a* in the second cylinder 44 communicate with each other through a through-hole 43*a* formed in the intermediate plate 43. Thus, the working chamber 55*b* and the working chamber 56*a* function as a single expansion chamber.

In the present embodiment, the thickness of the first cylinder 42 and that of the second cylinder 44 are made different from each other to obtain a greater total volumetric capacity of the working chamber 56*a* and the working chamber 56*b* than that of the working chamber 55*a* and the working chamber 55*b*. In this regard, it is also possible to adopt a configuration in which the inner diameters of the cylinders or the outer diameters of the pistons are made different from each other. Furthermore, the second piston 47 and the second vane 49 may be integrated as a single unit, called a swinging piston.

As shown in FIG. 2, the expansion mechanism 3 further includes a suction pipe 52 for drawing the working fluid to be expanded directly from the outside of the closed casing 1, and a discharge pipe 53 for discharging the expanded working fluid directly to the outside of the closed casing 1. The suction pipe 52 is inserted directly into the lower bearing member 41 and connected to the suction port 41*p* so that the working fluid can be delivered from the outside of the closed casing 1 to the working chamber 55 of the first cylinder 42. The discharge pipe 53 is inserted directly into the upper bearing member 43 and connected to the discharge port 45*q* so that the working fluid can be delivered from the working chamber 56 of the second cylinder 44 to the outside of the closed casing 1.

The working fluid to be expanded passes through the suction pipe 52 and the suction port 41*p*, and then flows into the working chamber 55*a* of the first cylinder 42. The working fluid that has flowed into the working chamber 55*a* of the first cylinder 42 moves to the working chamber 55*b* as the shaft 5 rotates, and expands in the expansion chamber formed by the working chamber 55*b*, the through-hole 43*a*, and the working chamber 56*a*, while rotating the shaft 5. The working fluid thus expanded is delivered to the outside of the closed casing 1 through the working chamber 56*b*, the discharge port 45*q*, and the discharge pipe 53.

Figure 4A:
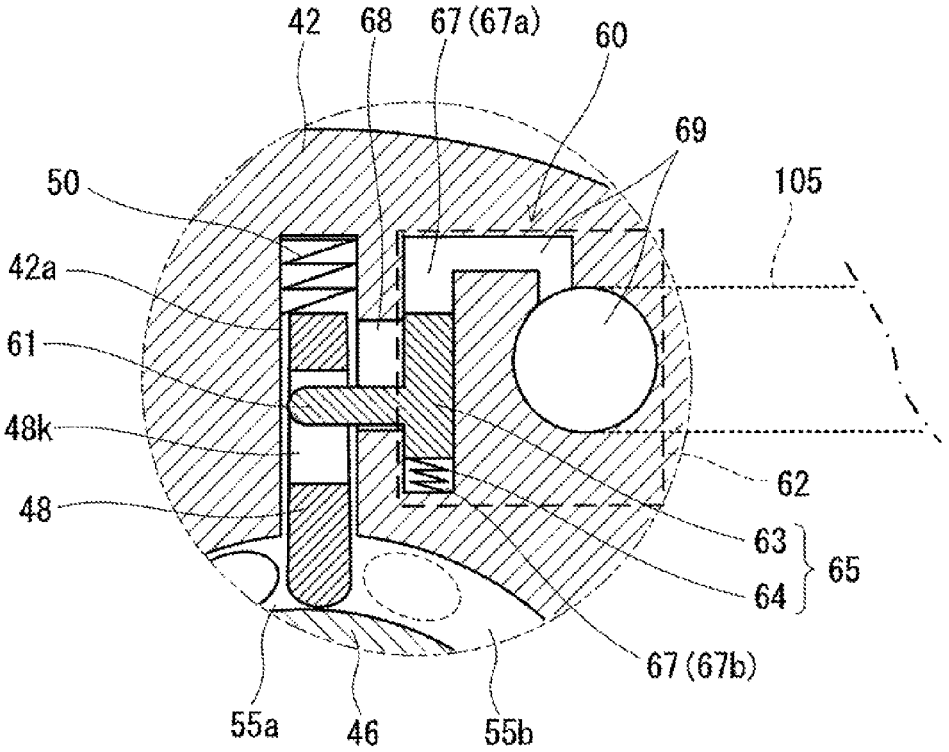
FIG. 4A is a partially enlarged view of FIG. 3A, showing a variable vane mechanism at the minimum suction volume.
Figure 4B:
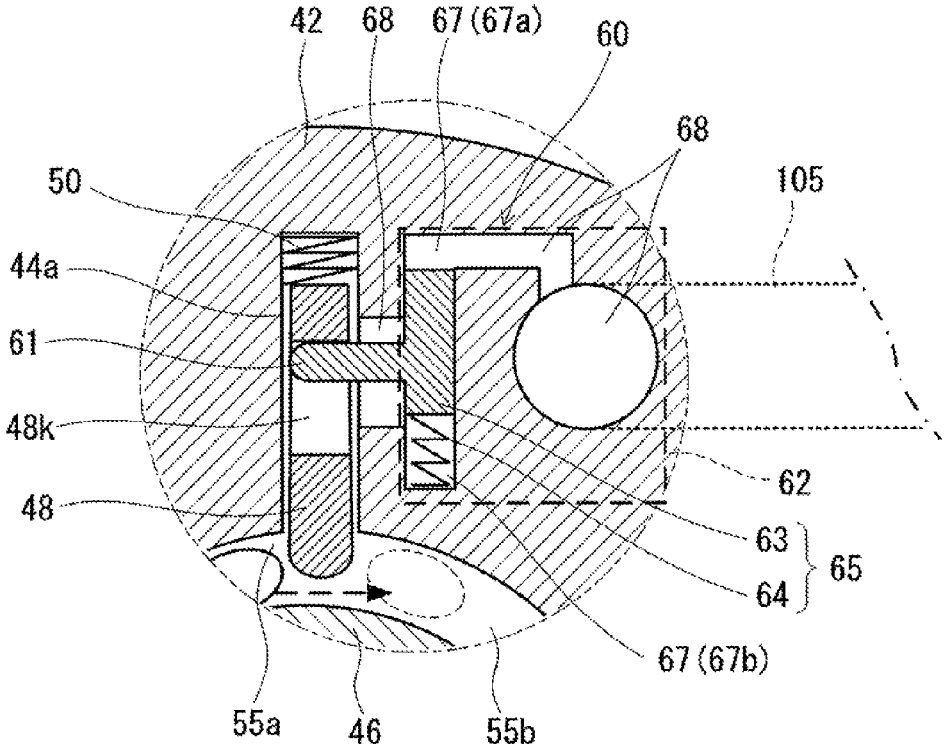
FIG. 4B is a partially enlarged view of FIG. 3A, showing the variable vane mechanism at a larger suction volume than in FIG. 4A.

FIG. 4A shows an enlarged view of the variable vane mechanism at the minimum suction volume. FIG. 4B shows an enlarged view of the variable vane mechanism at a larger suction volume than in FIG. 4A. In the present description, a period during which the tip of the first vane 48 is in contact with the first piston 46 in the course of one rotation of the shaft 5 is denoted as $P_1$, and a period during which the tip of the first vane 48 is spaced from the first piston 46 in the course of one rotation of the shaft 5 is denoted as $P_2$. During the period $P_2$, the working fluid can flow from the first suction space 55*a* into the first discharge space 55*b*. The variable vane mechanism 60 controls the movement of the first vane 48 so that the ratio of the period $P_2$ to the period $P_1(P/P_1)$ can be adjusted. The length of the period $P_1$ and the length of the period $P_2$ each can be represented by an angle (in degrees). When the ratio $(P_2/P_1)$ changes, the suction volume (volumetric flow rate) of the expansion mechanism 3 also changes. That is, the constraint of constant density ratio can be avoided. The power recovery efficiency can be optimized by adjusting the ratio $(P_2/P_1)$ according to the heat source temperature (for example, an outside air temperature).

In the present embodiment, the suction volume of the expansion mechanism 3 is minimum when the period $P_2$ is 0, that is, when the first vane 48 and the first piston 46 are always in contact with each other. In this regard, the minimum value of the period $P_2$ may be greater than zero.

As shown in FIG. 4A and FIG. 4B, the variable vane mechanism 60 includes a stopper 61 and an actuator 62. The stopper 61 serves to limit the range of movement of the first vane 48. The actuator 62 serves to move the stopper 61 in the direction from a position for increasing the range of the movement of the first vane 48 to a position for reducing the range of the movement, or in the opposite direction. This mechanism is advantageous in that the actuator 62 moves the stopper 61 so that the length of the stroke of the first vane 48 can be changed mechanically. Furthermore, this mechanism rarely requires a high precision control technique because the stopper 61 does not need to be moved according to the rotation angle of the shaft 5, and therefore is highly reliable.

Specifically, the actuator 62 is composed of a main body 65, a pressure chamber 67 in which the main body 65 is placed, and a passage 69 for supplying a fluid to the pressure chamber 67. The main body 65 includes a portion working with the stopper 61, and determines, based on the pressure of the fluid, the position of the stopper 61 with respect to the longitudinal direction of the first vane groove 42*a*. Thus, in the present embodiment, a fluid pressure actuator is used as the actuator 62. The working fluid in the refrigeration cycle apparatus 200A is used as the fluid to be supplied to the pressure chamber 67. The use of the working fluid as a power source allows some leakage of the working fluid from the pressure chamber 67 to the first vane groove 42*a*. Therefore, tight sealing is not required.

The main body 65 includes a slider 63 disposed slidably in the pressure chamber 67 to partition the pressure chamber 67 into sections, and a spring 64 provided in one section 67*b* of the pressure chamber 67 partitioned by the slider 63. The stopper 61 is integrated with the slider 63. The passage 69 is connected to the other section 67*a* of the pressure chamber 67 partitioned by the slider 63. Like the first vane groove 42*a*, the pressure chamber 67 and the passage 69 are spaces formed in the first cylinder 42. The pipe 105 of the pressure supply circuit 110, which has been described with reference to FIG. 1, is connected to the passage 69. The position of the stopper 61 with respect to the longitudinal direction of the first vane groove 42*a* is determined based on the force applied to the slider 63 by the working fluid that has been supplied to the pressure chamber 67*a* through the pipe 105 and the passage 69 and the force applied to the slider 63 by the spring 64. The stopper 61 can move, together with the slider 63, in the direction parallel to the longitudinal direction of the first vane groove 42*a*. In such a configuration, the position of the stopper 61 can be changed freely and continuously by adjusting the pressure in the pressure chamber 67*a*. This means that the power recovery efficiency can be optimized easily.

Furthermore, it is possible to adopt not only the mechanism for changing the position of the stopper 61 continuously but also the mechanism for changing the position of the stopper 61 stepwise. In some cases, the position of the stopper 61 may only need to be changed from one position with a larger ratio $(P_2/P_1)$ to the other position with a smaller ratio $(P_2/P_1)$, or from the other position to the one position.

The pressure chamber 67 and the passage 69 may be formed in the bearing member 41 of the expansion mechanism 3 (see FIG. 2). That is, the variable vane mechanism 60 may be built in the bearing member 41. The stopper 61 and the slider 63 may be constituted by separate components. In this case, the slider 63 and the stopper 61 may be coupled together by direct fitting, or they may be coupled together by another member.

The first vane 48 has a recessed portion 48*k* (notched groove) for laterally receiving the stopper 61. The pressure chamber 67 of the fluid pressure actuator 62 is formed adjacent to the first vane groove 42*a* in the first cylinder 42. A groove 68 for allowing the stopper 61 to pass through is formed between the first vane groove 42*a* and the pressure chamber 67. One end of the stopper 61 is fixed to the slider 63 and the other end thereof is inserted into the recessed portion 48*k* so that the stopper 61 extends from the pressure chamber 67 to the first vane groove 42*a* through the groove 68. In such a configuration, the range of the movement of the first vane 48 can be limited easily by fitting the stopper 61 in the recessed portion 48*k* of the first vane 48.

The relationship of Lc>Ws+Tmax is satisfied when the length of the recessed portion 48*k* with respect to the longitudinal direction of the first vane groove 42*a* is Lc, the width of the stopper 61 with respect to this longitudinal direction is Ws, and the maximum length of the stroke of the first vane 48 is Tmax. When this relationship is satisfied, the period $P_2$ of 0 can be selected, that is, the interference between the first vane 48 and the stopper 61 can be avoided, and as a result, a wide range of adjustment of the suction volume can be achieved.

In the operation mode (first mode) shown in FIG. 4A, the pressure chamber 67*a* is filled with the high-pressure working fluid, and thus the slider 63 and the stopper 61 are pressed downward. When the stopper 61 is in this position, the stopper 61 and the first vane 48 do not interfere with each other, and thus the range of the movement of the first vane 48 is not limited. The first vane 48 can move freely within the maximum stroke Tmax, so that the contact state between the first vane 48 and the first piston 46 is always maintained.

On the other hand, in the operation mode (second mode) shown in FIG. 4B, the pressure chamber 67*a* is filled with the low-pressure or intermediate-pressure working fluid, and thus the slider 63 and the stopper 61 move to a position above the position shown in FIG. 4A. Specifically, the slider 63 and the stopper 61 move to the position where the force applied to the slider 63 by the working fluid filled in the pressure chamber 67*a* and the force applied to the slider 63 by the spring 64 (elastic force) are balanced with each other. When the stopper 61 is in this position, the stopper 61 and the first vane 48 interfere with each other, and thus the range of the movement of the first vane 48 is limited. As a result, the first vane 48 cannot move to the lowest point. During the period $P_2$ in which the movement of the first vane 48 is restricted by the stopper 61, the first vane 48 is spaced from the first piston 46. During this period, the high-pressure working fluid filled in the working chamber 55*a* (first suction space) flows directly into the working chamber 55*b* (first discharge space) filled with the intermediate-pressure working fluid.

When the pressure in the pressure chamber 67*a* is changed, the position of the stopper 61 changes, and the period $P_2$ (injection period) changes accordingly. The lower the pressure in the pressure chamber 67*a* is, the higher the stopper 61 is positioned. Therefore, the range of the movement of the first vane is reduced accordingly. Then, the period $P_1$ in which the first vane 48 is in contact with the first piston 46 becomes progressively shorter while the period $P_2$ becomes progressively longer, and as a result, the working fluid in the working chamber 55*a* flows more into the working chamber 55*b*. In this way, the amount of the working fluid injected into the expansion chamber can be adjusted by adjusting the pressure in the pressure chamber 67*a*. In other words, the suction volume of the expansion mechanism 3 can be adjusted freely.

The pressure in the pressure chamber 67*a* can be adjusted by the throttle valve 104 of the pressure adjustment circuit 110. That is, the position of the stopper 61 can be controlled by adjusting the opening of the throttle valve 104. When the opening of the throttle valve 104 is increased, the pressure in the pressure chamber 67*a* increases, and the stopper 61 moves downward. As a result, the injection amount decreases to a smaller value or to zero. When the opening of the throttle valve 104 is reduced, the pressure in the pressure chamber 67*a* decreases, and the stopper 61 moves upward. As a result, the injection amount increases.

As described with reference to FIG. 1, the fine passage 106 bridges the pipe 105 and the pipe 103*c* between the throttle valve 104 and the variable vane mechanism 60. Therefore, the pressure in the pressure chamber 67*a* of the variable vane mechanism 60 can be changed between the high pressure and the low pressure of the refrigeration cycle by adjusting the opening of the throttle valve 104. The amount of the working fluid flowing through the fine passage 106 is so small that it has little effect on the power recovery efficiency.

Next, the operating principle of the expansion mechanism 3 at the minimum suction volume is described with reference to FIG. 5.

Figure 5:
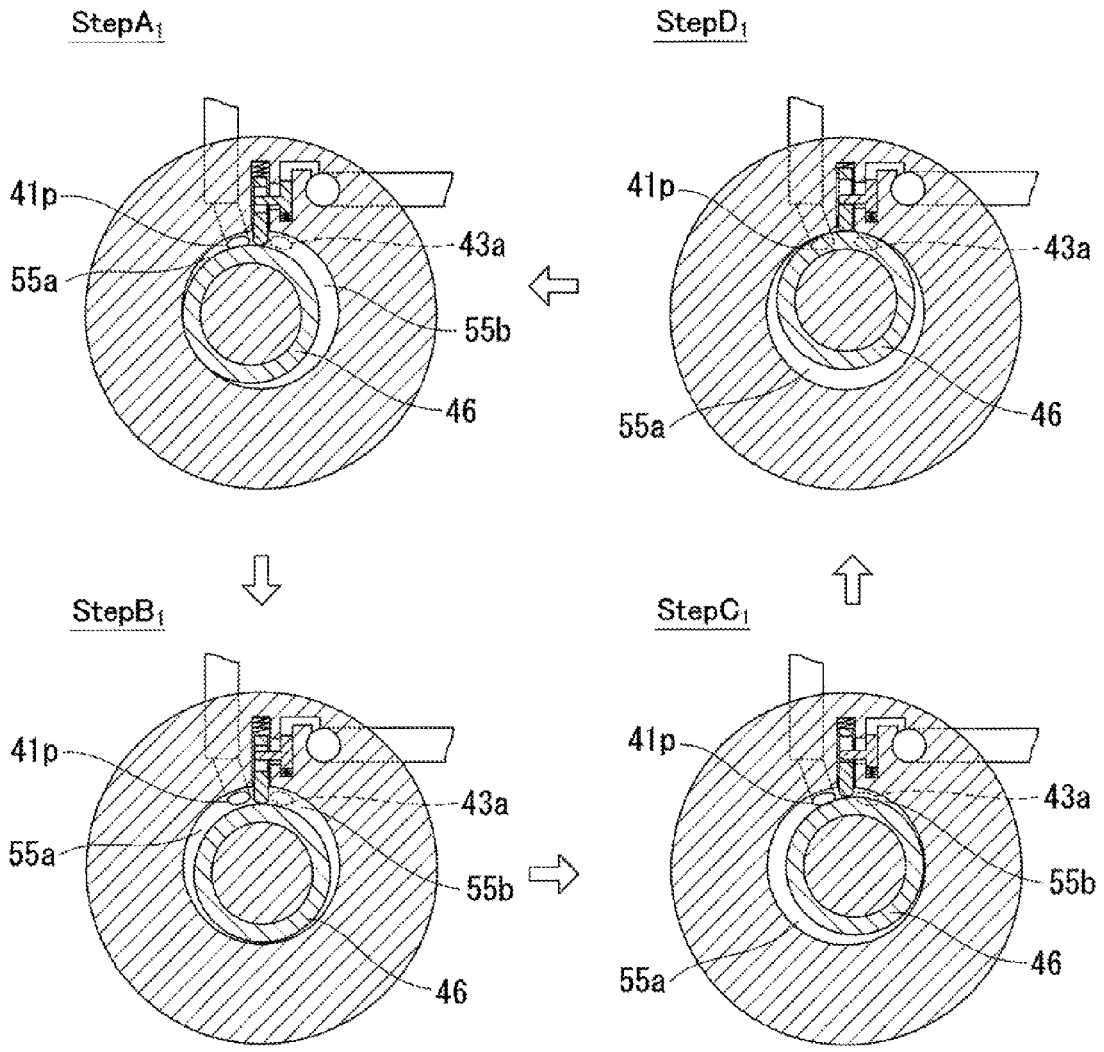
FIG. 5 is a diagram showing the operating principle of an expansion mechanism at the minimum suction volume.

As shown in Step $A_1$ in FIG. 5, when the first piston 46 rotates in a counterclockwise direction and the suction port 41*p* is opened, the drawing of the working fluid into the first suction space 55*a* (suction process) starts. Next, as shown in Step $B_1$ and Step $C_1$ in FIG. 5, as the first piston 46 rotates, the working fluid is further drawn into the first suction space 55*a*. As shown in Step $D_1$ in FIG. 5, when the first piston 46 further rotates and the suction port 41*p* is closed, the drawing of the working fluid into the first suction space 55*a* is completed.

When the suction process is completed, the first suction space 55*a* is shifted to the first discharge space 55*b*. As described with reference to FIG. 3A and FIG. 3B, the first discharge space 55*b* and the second suction space 56*a* communicate with each other through the through-hole 43*a*. As shown in Steps $A_1$ to $C_1$ in FIG. 5, the working fluid filled in the first discharge space 55*b* moves to the second suction space 56*a* of the second cylinder 44 through the through-hole 43*a* as the first piston 46 rotates. The increase in the volumetric capacity of the second suction space 56*a* with the rotation of the shaft 5 is greater than the decrease in the volumetric capacity of the first discharge space 55*b*. Therefore, the working fluid expands in the first discharge space 55*b*, the through-hole 43*a*, and the second suction space 56*a* (expansion process). When the first piston 46 closes the through-hole 43*a* completely, the movement of the working fluid into the second suction space 56*a* and the expansion thereof are completed.

When the expansion process is completed, the second suction space 56*a* is shifted to the second discharge space 56*b*, as described with reference to FIG. 3B. The discharge of the working fluid filled in the second discharge space 56*b* to the outside through the discharge port 45*q* (discharge process) starts. When the second piston 47 further rotates and the discharge port 45*q* is closed, the discharge of the working fluid in the second discharge space 56*b* to the outside is completed. By repeating the above processes, the working fluid expands and the expansion energy is recovered.

Next, the operating principle of the expansion mechanism 3 at a larger suction volume than in FIG. 5 will be described with reference to FIG. 6.

Figure 6:
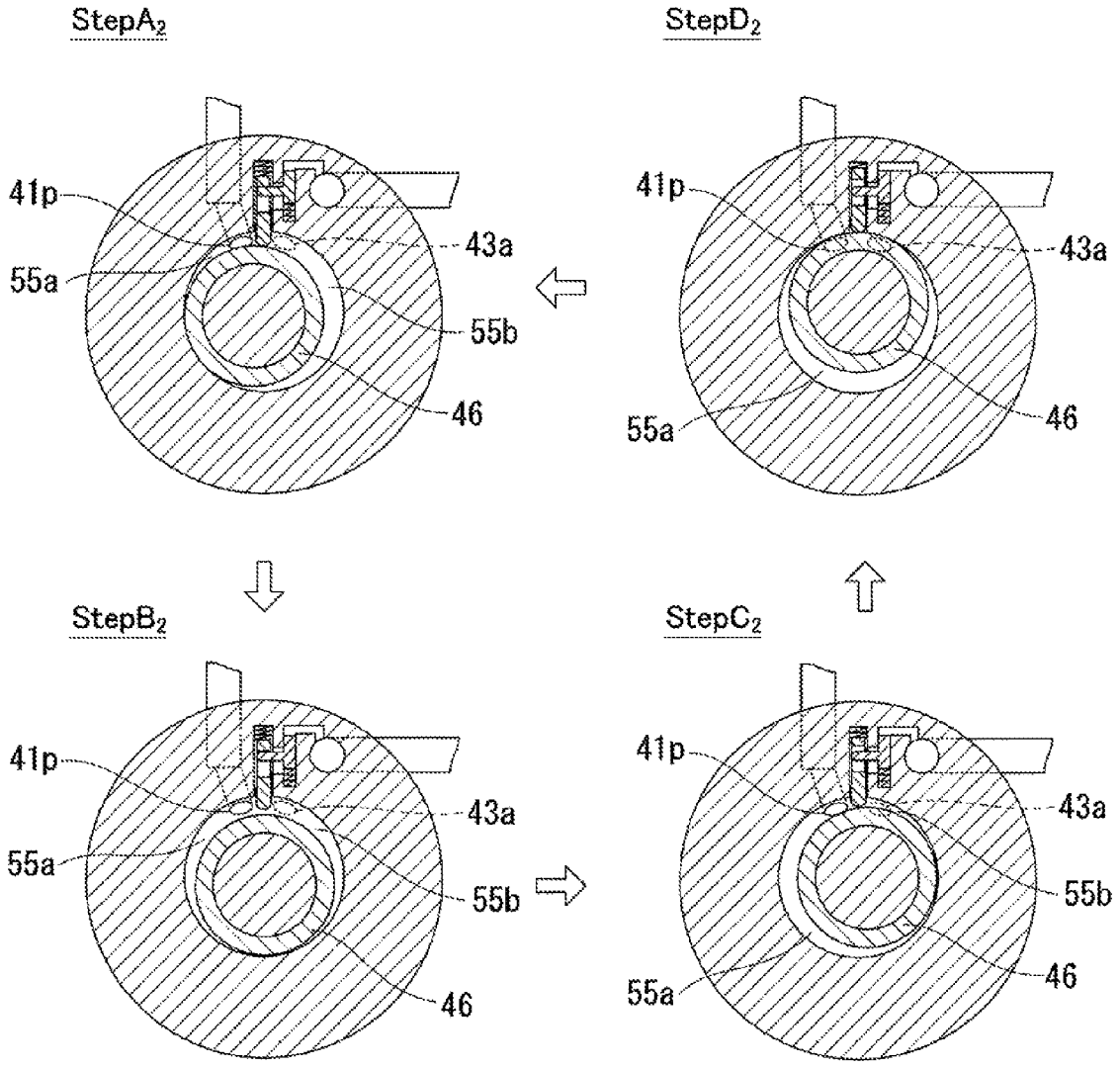
FIG. 6 is a diagram showing the operating principle of the expansion mechanism at a larger suction volume than in FIG. 5.

As shown in Step $A_2$ in FIG. 6, when the first piston 46 rotates in a counterclockwise direction and the suction port 41*p* is opened, the drawing of the working fluid into the first suction space 55*a* (suction process) starts. Next, as shown in Step $B_2$ in FIG. 6, when the first piston 46 further rotates, the first vane 48 and the stopper 61 interfere with each other, and thus the first vane 48 is prevented from moving (downward). As a result, the first vane 48 is detached from the first piston 46, and a flow path from the first suction space 55*a* to the first discharge space 55*b* is formed. Thus, the high-pressure working fluid in the first discharge space 55*a* flows into the first discharge space 55*b*. The high-pressure working fluid also flows into the second suction space 56*a* that communicates with the first discharge space 55*b*. That is, the first vane 48 is detached from the first piston 46 in the course of the expansion of the working fluid in the expansion chamber, so that the working fluid to be expanded is injected into the expansion chamber.

As shown in Step $C_2$ in FIG. 6, when the first piston 46 further rotates and the first vane 48 and the first piston 46 again come into contact with each other, the first suction space 55*a* and the first discharge space 55*b* are separated again by the first vane 48. Thus, the flow of the working fluid from the first suction space 55*a* to the first discharge space 55*b* is inhibited. As shown in Step $D_2$ in FIG. 6, when the first piston 46 further rotates and the suction port 41*p* is closed, the drawing of the working fluid into the first suction space 55*a* is completed. When the suction process is completed, the first suction space 55*a* is shifted to the first discharge space 55*b*. The first discharge space 55*b* and the second suction space 56*a* communicate with each other through the through-hole 43*a*, and the expansion process starts. The operations in Steps $A_2$ to $D_2$ in FIG. 6 are repeated in this manner.

Figure 7A:
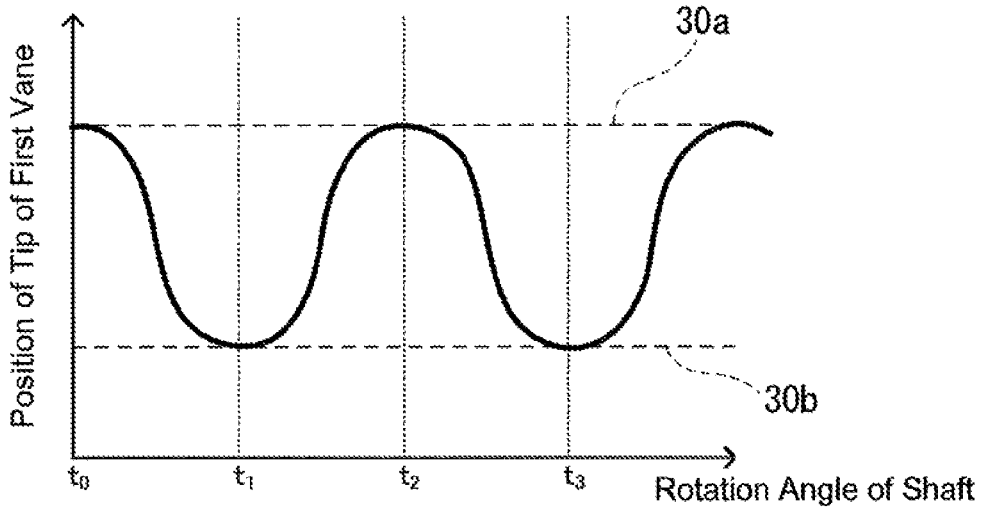
FIG. 7A is a graph corresponding to FIG. 5, showing the position of the tip of a first vane.

FIG. 7A is a graph corresponding to FIG. 5, showing the position of the tip of the first vane. The vertical axis represents the position of the tip of the first vane 48. The position of the tip of the first vane 48 corresponds to the distance from the rotational axis of the shaft 5 to the tip of the first vane 48. The horizontal axis represents the rotation angle of the shaft 5 with respect to the position of the shaft at the moment when the first piston 46 occupies the top dead center. Specifically, the rotation angles $t_0$, $t_1$, $t_2$, and $t_3$ are 0 degree, 180 degrees, 360 degrees, and 540 degrees, respectively. The "top dead center" means the position of the piston in a state in which the vane is pressed into the vane groove most inwardly. The "bottom dead center" means the position of the piston 180-degree opposite to the "top dead center".

At the angles $t_0$ and $t_2$ at which the first piston 46 is in the top dead center, the tip of the first vane 48 is in the upper limit position 30*a* farthest from the rotational axis of the shaft 5. At the angles $t_1$ and $t_3$ at which the first piston 46 is in the bottom dead center, the tip of the first vane 48 is in the lower limit position 30*b* nearest to the rotational axis of the shaft 5. The tip of the first vane 48 undergoes simple harmonic motion in synchronism with the rotation of the shaft 5.

Figure 7B:
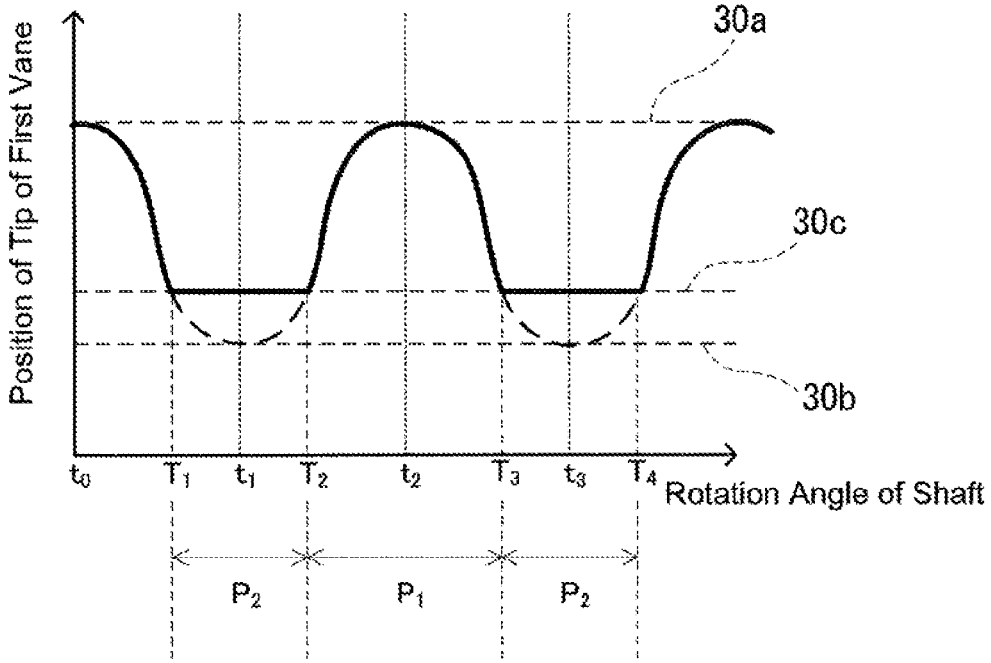
FIG. 7B is a graph corresponding to FIG. 6, showing the position of the tip of the first vane.

FIG. 7B is a graph corresponding to FIG. 6, showing the position of the tip of the first vane. At the angles $t_0$ and $t_2$, the tip of the first vane 48 is in the upper limit position 30*a*, as in FIG. 5. When the stopper 61 prevents the first vane 48 from moving downward at the angle $T_1$, the tip of the first vane 48 occupies the position 30*c* between the upper limit position 30*a* and the lower limit position 30*b*. When the first vane 48 and the first piston 46 again come into contact with each other at the angle $T_2$, the tip of the first vane 48 begins to be displaced to the upper limit position 30*a*. During the period $P_2$ (the period $T_2$-$T_1$ and the period $T_4$-$T_3$) in which the tip of the first vane 48 stays in the position 30*c*, the working fluid is injected into the expansion chamber. The injection amount of the working fluid increases or decreases according to the length of the period $P_2$. In other words, it increases or decreases according to the ratio of the period $P_2$ to the period $P_1$ ($P_2/P_1$). The length of the period $P_2$ varies depending on the pressure in the pressure chamber 67*a* of the variable vane mechanism 60.

The range of the ratio ($P_2/P_1$) is not particularly limited. For example, $P_2$ is in the range of 0 to 180 (degrees) ($0 \le P_2 \le 180$) and $P_2/P_1$ is in the range of 0 to 1 ($0 \le P_2/P_1 \le 1$). That is, the position of the stopper 61 may be adjusted so that the period $P_2$ falls within the period in which the rotation angle of the shaft 5 is in the range of 90 to 270 degrees, if the rotation angle of the shaft 5 at the moment when the first piston 46 occupies the top dead center is defined as 0 degree.

As described above, with the expansion mechanism 3 provided with the variable vane mechanism 60, the working fluid can be injected into the expansion chamber at the same time as it is drawn into the first suction space 55*a*. Therefore, the volume of the working fluid to be drawn into the expansion mechanism 3 during one rotation of the shaft can be changed. Furthermore, the injection amount can be changed by adjusting the opening of the throttle valve 104.

(Second Embodiment)

Figure 8:
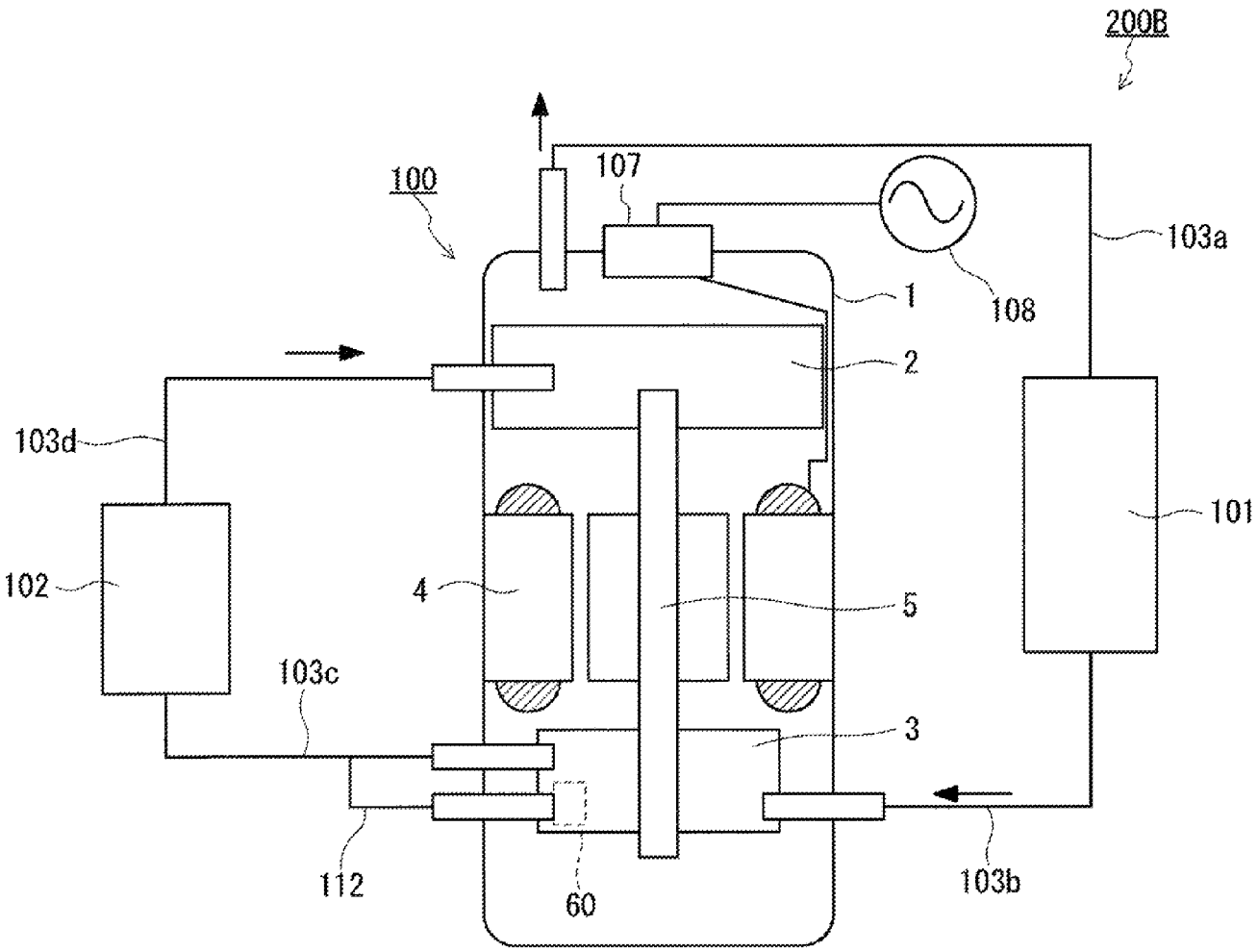
FIG. 8 is a configuration diagram showing a refrigeration cycle apparatus according to a second embodiment of the present invention.

FIG. 8 shows a refrigeration cycle apparatus according to the second embodiment of the present invention. A refrigeration cycle apparatus 200B of the present embodiment includes, instead of the pressure supply circuit 110, a pipe 112 connecting the pipe 103*c* and the variable vane mechanism 60. This refrigeration cycle apparatus 200B is different from that of the first embodiment in that the discharge pressure of the expansion mechanism 3 is supplied to the pressure chamber 76*a* of the variable vane mechanism 60. In the following embodiments, the same components are designated by the same reference numerals, and no further description is given.

In the refrigeration cycle apparatus 200B, the position of the stopper 61 changes according to the discharge pressure of the expansion mechanism 3, and thus the ratio ($P_2/P_1$) changes. The lower the discharge pressure of the expansion mechanism 3 is, the higher the stopper 61 is positioned. As a result, the period $P_2$ in which the first piston 46 and the first vane 48 are spaced from each other is increased, and thus the injection amount increases. Conversely, the higher the discharge pressure of the expansion mechanism 3 is, the lower the stopper 61 is positioned. As a result, the period $P_2$ in which the first piston 46 and the first vane 48 are spaced from each other is reduced, and thus the injection amount decreases. In this way, the position of the stopper 61 changes automatically according to the discharge pressure of the expansion mechanism 3, and thus the injection amount increases or decreases automatically. Therefore, efficient operation can be achieved without adjustment of the opening of the valve, or the like.

(Third Embodiment)

Figure 9:
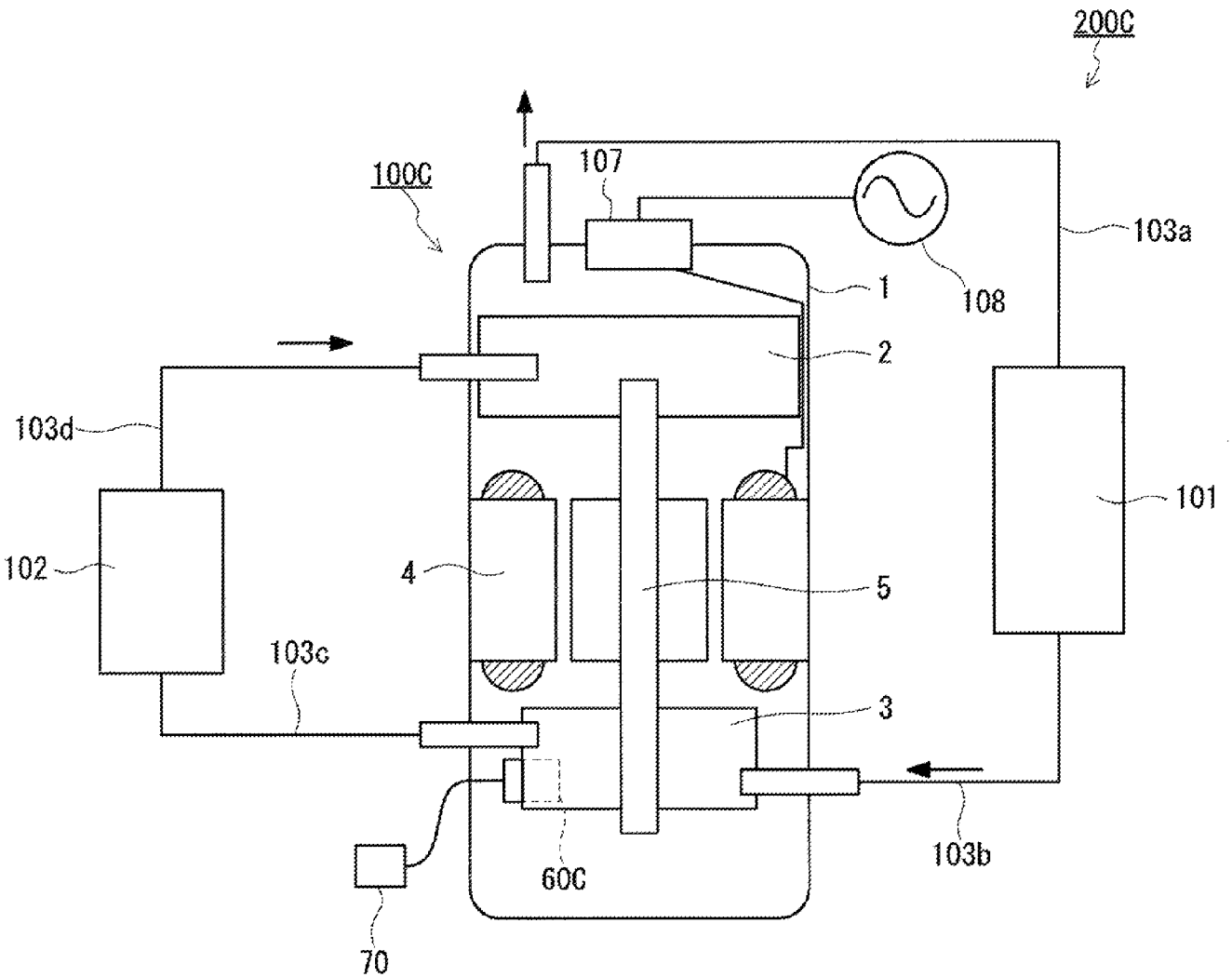
FIG. 9 is a configuration diagram showing a refrigeration cycle apparatus according to a third embodiment of the present invention.

The actuator of the variable vane mechanism is not limited to a fluid pressure actuator. FIG. 9 is a configuration diagram showing a refrigeration cycle apparatus using an electric actuator as an actuator of the variable vane mechanism. This refrigeration cycle apparatus 200C has an expander-integrated compressor 100C. The expansion mechanism 3 in the expander-integrated compressor 100C is provided with a variable vane mechanism 60C including an electric actuator. The electric actuator of the variable vane mechanism 60C is connected to an external controller 70. The operation of the electric actuator can be controlled by the external controller. The refrigeration cycle apparatus 200C has an advantage in that the pressure supply circuit 110 described with reference to FIG. 1 can be omitted. Furthermore, since the positioning accuracy of the stopper can be increased easily by the electric actuator, the injection amount can be optimized more easily.

Figure 10A:
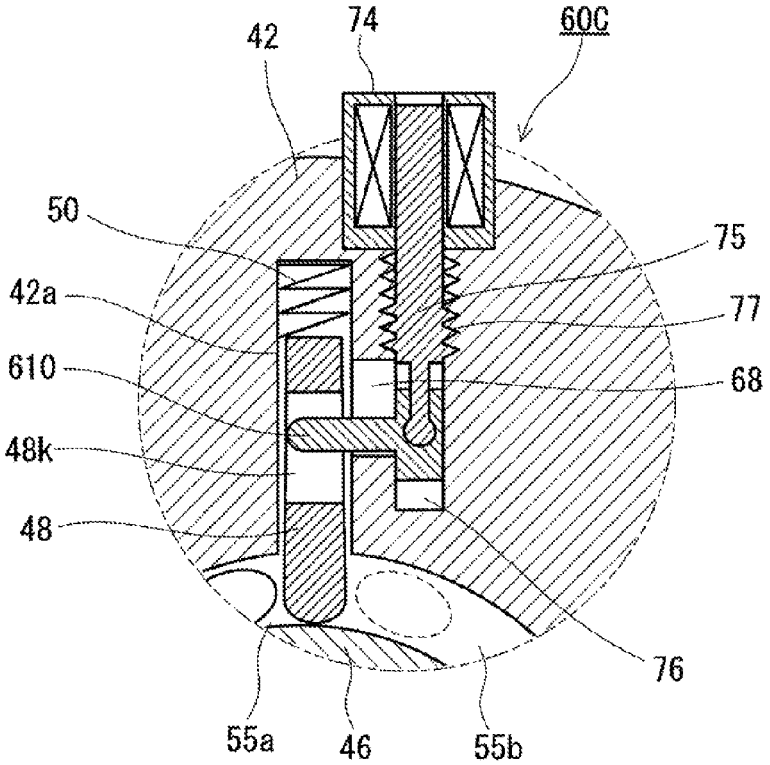
FIG. 10A is a partially enlarged view of a variable vane mechanism using an electric actuator.
Figure 10B:
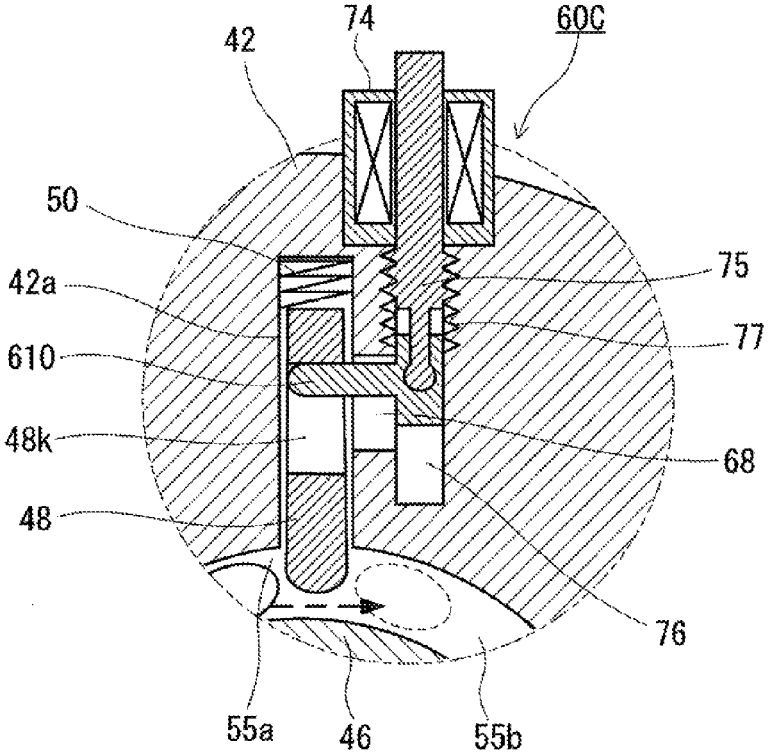
FIG. 10B is a partially enlarged view of the variable vane mechanism at a larger suction volume than in FIG. 10A.

As shown in FIG. 10A and FIG. 10B, in the variable vane mechanism 60C, a rotary motor 74 is used as an actuator for moving the stopper 610. The rotary motor 74 and the stopper 610 are coupled together so that the position of the stopper 610 with respect to the longitudinal direction of the first vane groove 42*a* changes when the rotary motor 74 is driven.

Specifically, a slide bar 75 with a male-threaded outer peripheral surface is attached to the rotary motor 74. A groove 76 that communicates with the first vane groove 42*a* through the groove 68 is formed in the first cylinder 42. A female thread is cut on the inner peripheral surface of the groove 76. The slide bar 75 is disposed rotatably in the groove 76 in such a manner that the male and female threads are engaged with each other. The stopper 610 is constituted by a component having a T-shaped transverse cross-section. One end of the stopper 610 is inserted into the recessed portion 48*k* of the first vane 48, and the other end of the stopper 610 is accommodated in the groove 76. In the groove 76, the tip of the slide bar 75 is fitted rotatably to the other end of the stopper 610. When the rotary motor 74 is driven, the slide bar 75 rotates and moves forward or backward in the groove 76. Along with the movement of the slide bar 75, the stopper 610 moves in the direction parallel to the longitudinal direction of the first vane groove 42*a*. The function and movement of the stopper 610 are basically the same as those of the stopper 61 described in the first embodiment.

As shown in FIG. 10A, when the rotary motor 74 is rotated in the normal direction to press the slide bar 75 and the stopper 610 downward, the stopper 610 and the first vane 48 do not interfere with each other. Therefore, the range of the movement of the first vane 48 is not limited. The first vane 48 can move freely within the maximum stroke Tmax, so that the contact state between the first vane 48 and the first piston 46 is always maintained.

On the other hand, as shown in FIG. 10B, when the rotary motor 74 is rotated in the reverse direction to press the slide bar 75 and the stopper 610 upward, the stopper 610 and the first vane 48 interfere with each other. Therefore, the range of the movement of the first vane 48 is limited, so that the first vane 48 cannot move to the lowest point. During the period $P_2$ in which the movement of the first vane 48 is restricted by the stopper 610, the first vane 48 is spaced from the first piston 46. During this period, the high-pressure working fluid filled in the first suction space 55*a* flows directly into the first discharge space 55*b* (expansion chamber) filled with the intermediate-pressure working fluid.

The stopper 610 can be moved by controlling the driving of the rotary motor 74 by the external controller 70 (FIG. 9). When the stopper 610 is moved, the period $P_2$ in which the first vane 48 is spaced from the first piston 46 changes, and thus the injection amount changes. Since the stopper 610 can be locked securely, the injection amount can be maintained at a constant value easily.

A linear motor may be used instead of the rotary motor 74. A solenoid may be used as an electric actuator. Furthermore, the rotary motor 74 may be a servomotor or a stepping motor. With any of these motors, the position of the stopper 610 with respect to the longitudinal direction of the first vane groove 42*a* can be controlled precisely. Alternatively, a simple positioning element may be used to detect the positions of the slide bar 75 and the stopper 610 and control the driving of the rotary motor 74 based on the detection results. For example, one or a plurality of limit switches may be provided along the longitudinal direction of the slide bar 75, so that the driving of the rotary motor 74 can be controlled based on the detection signals of the limit switches.

Furthermore, the injection amount can be controlled based on the discharge pressure of the expansion mechanism 4 or the evaporation temperature of the working fluid in the evaporator 102. The injection amount may be controlled based on at least one temperature selected from the group consisting of the discharge temperature of the compression mechanism 2, the suction temperature of the compression mechanism 2, and the suction temperature of the expansion mechanism 3. This also applies to the other embodiments.

(Fourth Embodiment)

Figure 11:
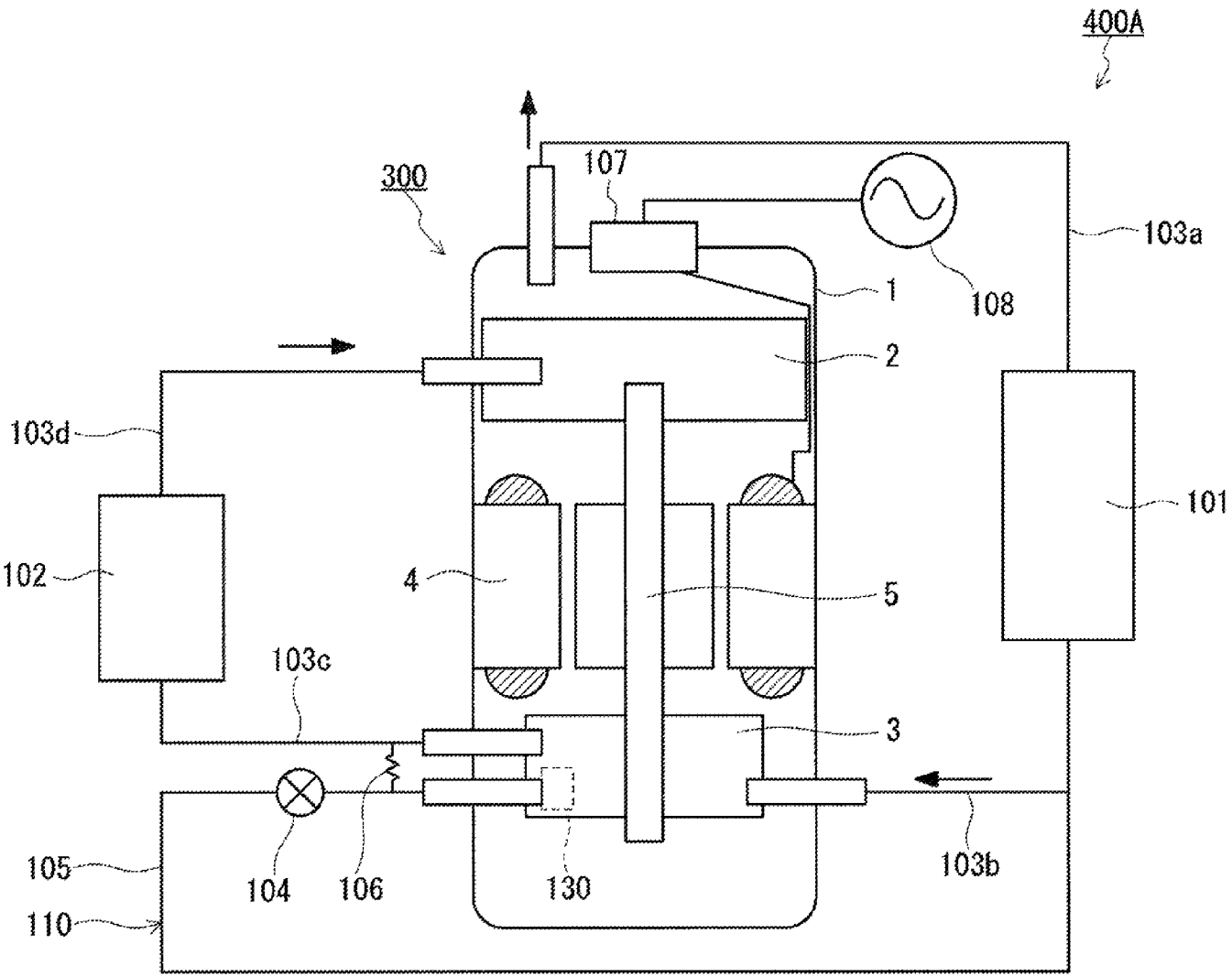
FIG. 11 is a configuration diagram showing a refrigeration cycle apparatus according to a fourth embodiment of the present invention.

As shown in FIG. 11, the basic configuration of a refrigeration cycle apparatus 400A of the present embodiment is the same as that of the first embodiment described with reference to FIG. 1. The refrigeration cycle apparatus 400A includes an expander-integrated compressor 300 having a variable vane mechanism 130. In the present embodiment, a method of changing the confined volume of the expansion chamber is employed as a method of changing the volumetric flow rate of the expansion mechanism 3. The confined volume means the volumetric capacity of the expansion chamber at the time when the working fluid begins to expand. That is, the variable vane mechanism 130 can be a volume-changeable mechanism for changing the volumetric capacity of the expansion chamber at the start of the expansion.

The refrigeration cycle apparatus 400A further includes a pressure supply circuit 110 for adjusting the opening of a valve in the variable vane mechanism 130. The configuration of the pressure supply circuit 110 is as described with reference to FIG. 1.

Figure 12:
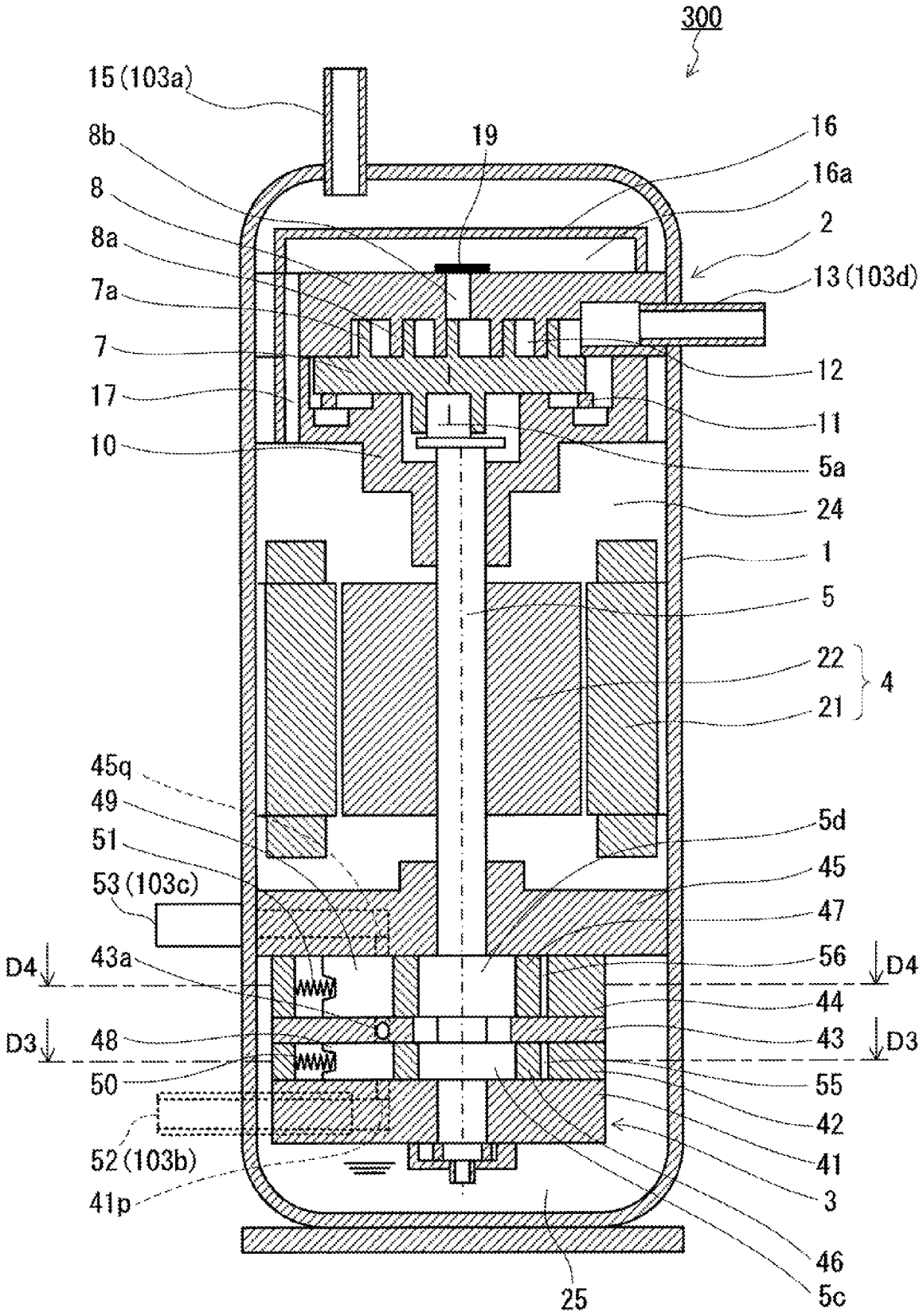
FIG. 12 is a longitudinal cross-sectional view of an expander-integrated compressor shown in FIG. 11.
Figure 13A:
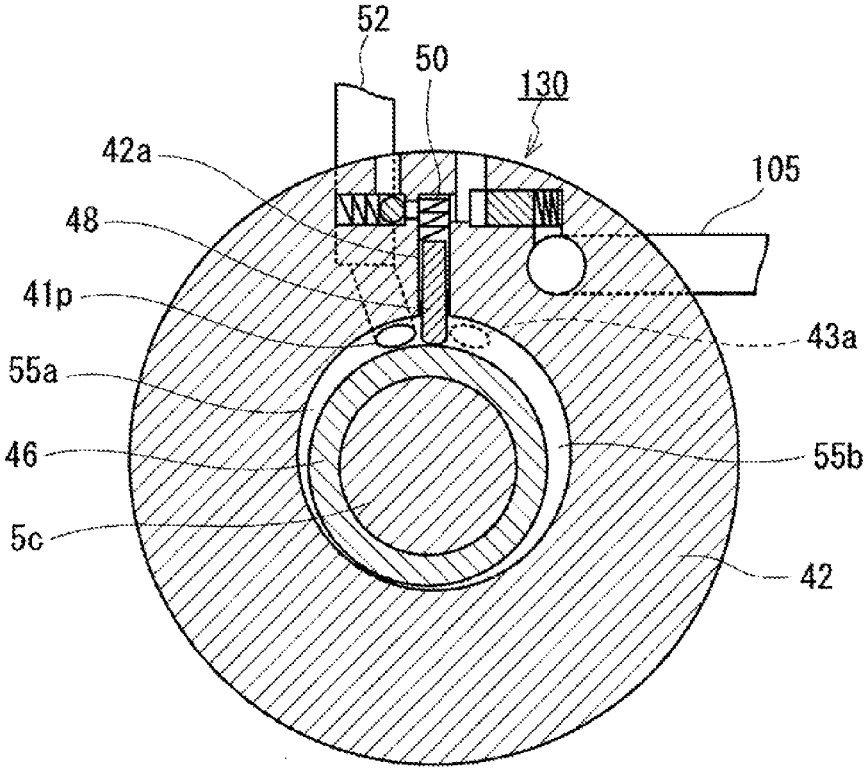
FIG. 13A is a transverse cross-sectional view of the expander-integrated compressor shown in FIG. 12, taken along the line D3-D3.
Figure 13B:
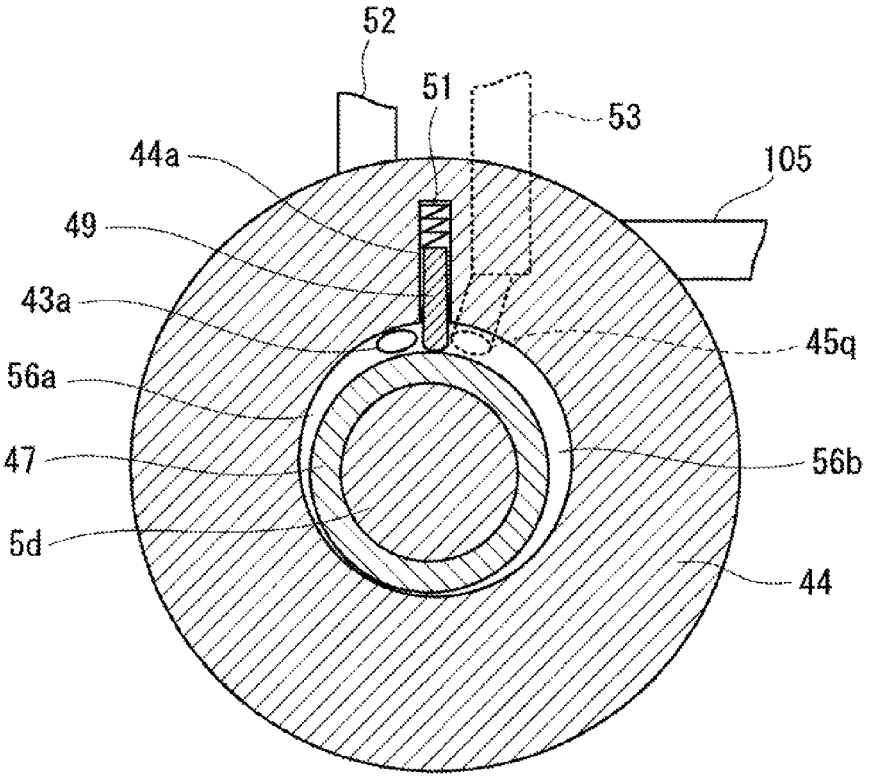
FIG. 13B is a transverse cross-sectional view of the expander-integrated compressor shown in FIG. 12, taken along the line D4-D4.

As shown in FIG. 12, FIG. 13A, and FIG. 13B, the configuration of the expander-integrated compressor 300 is basically the same as that of the expander-integrated compressor 100 described with reference to FIG. 2, except that the variable vane mechanism 130 provided in the expansion mechanism 3.

Figure 14A:
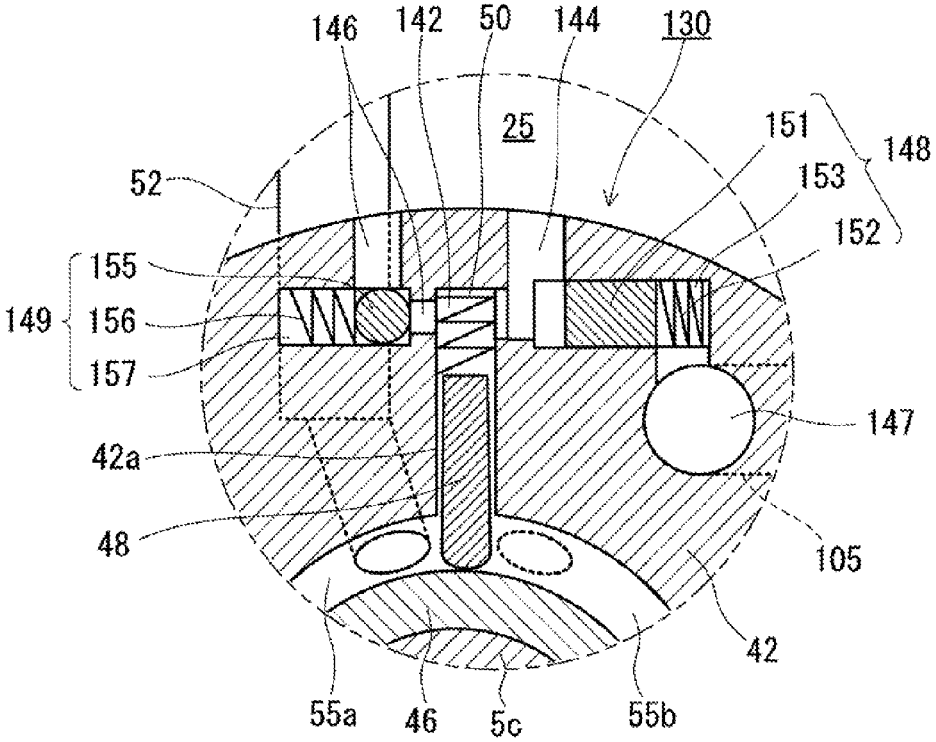
FIG. 14A is a partially enlarged view of FIG. 13A, showing a variable vane mechanism at the minimum confined volume.
Figure 14B:
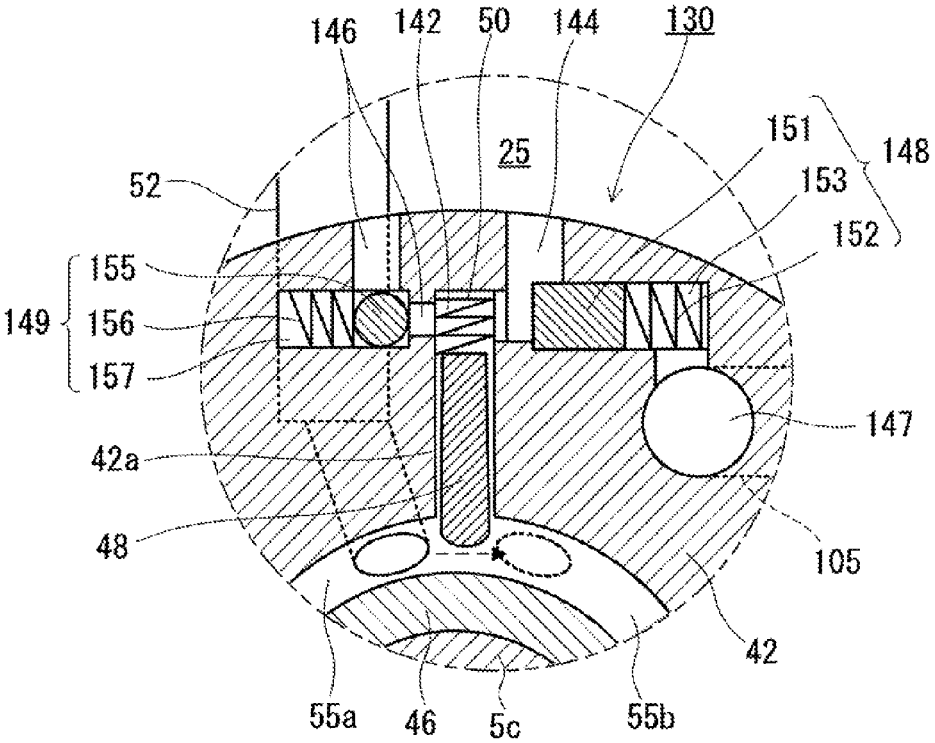
FIG. 14B is a partially enlarged view of FIG. 13A, showing the variable vane mechanism at a larger confined volume than in FIG. 14A.

FIG. 14A shows an enlarged view of the variable vane mechanism when it is controlled to have the minimum confined volume. FIG. 14B shows an enlarged view of the variable vane mechanism when it is controlled to have a larger confined volume than in FIG. 14A. Also in the present embodiment, the period in which the tip of the first vane 48 is in contact with the first piston 46 in the course of one rotation of the shaft 5 is denoted as $P_1$, and the period in which the tip of the first vane 48 is spaced from the first piston 46 in the course of one rotation of the shaft 5 is denoted as $P_2$. During the period $P_2$, the working fluid can flow from the first suction space 55*a* into the first discharge space 55*b*. The variable vane mechanism 130 controls the movement of the first vane 48 so that the ratio of the period $P_2$ to the period $P_1$ ($P_2/P_1$) can be adjusted.

In the present embodiment, the point in time when the first piston 46 reaches the top dead center is defined as the starting point of the period $P_2$. Therefore, the confined volume of the expansion chamber formed by the first discharge space 55*b*, the through-hole 43*a*, and the second suction space 56*a* changes according to the ratio ($P_2/P_1$). When the confined volume of the expansion chamber changes, the suction volume (volumetric flow rate) of the expansion mechanism 3 also changes. As a result, the constraint of constant density ratio can be avoided. The power recovery efficiency can be optimized by adjusting the ratio ($P_2/P_1$) according to the heat source temperature (for example, an outside air temperature).

Also in the present embodiment, the confined volume is minimum when the period $P_2$ is 0, that is, when the first vane 48 and the first piston 46 are always in contact with each other. The minimum value of the period $P_2$ may be greater than zero, of course.

As shown in FIG. 14A and FIG. 14B, the variable vane mechanism 130 includes an oil chamber 142, a first oil passage 144, a second oil passage 146, a first valve 148, a second valve 149, and a pressure supply passage 147. The oil chamber 142 communicates with the first vane groove 42*a* so that the oil can be supplied to the first vane groove 42*a* and the oil can be received from the first vane groove 42*a*. In the present embodiment, a part of the first vane groove 42*a* is used as the oil chamber 142.

In the present embodiment, the expansion mechanism 3 is placed in the lower part in the closed casing 1, and the space around the expansion mechanism 3 is filled with oil. The first oil passage 144 opens directly into the oil reservoir 25. Therefore, no oil pump is needed to pump the oil into the first oil passage 144.

Through the first oil passage 144, the oil in the oil reservoir 25 is supplied to the oil chamber 142 and the oil in the oil chamber 142 is discharged to the oil reservoir 25. The first valve 148 is an opening-adjustable valve provided in the first oil passage 144 so that the flow resistance (the inflow resistance and the outflow resistance) of the first oil passage 144 can be increased or decreased. If the flow resistance of the first oil passage 144 is increased or decreased, the flow rate of the oil flowing into the oil chamber 142 can be adjusted, and thus the movement of the first vane 48 can be controlled. This mechanism rarely requires a high precision control technique because the opening of the first valve 148 does not need to be adjusted according to the rotation angle of the shaft 5, and therefore is highly reliable.

Specifically, the first valve 148 has a valve body 151, a spring 152, and a pressure chamber 153. The valve body 151 and the spring 152 are placed in the pressure chamber 153. The spring 152 is placed behind the valve body 151 so that an elastic force is applied to the rear end surface of the valve body 151. The pressure supply passage 147 is connected to the portion of the pressure chamber 153 where the spring 152 is placed so that the pressure of the control fluid can be applied to the rear end surface of the valve body 151. The pressure of the control fluid and the elastic force of the spring 152 are applied to the rear end surface of the valve body 151. The position of the valve body 151 is determined according to the pressure of the control fluid supplied to the pressure chamber 153.

On the side of the head of the valve body 151, the range of the movement of the valve body 151 overlaps the first oil passage 144. As shown in FIG. 14A, when the valve body 151 occupies the most backward position, the cross-sectional area of the first oil passage 144 is maximum. As shown in FIG. 14B, when the valve body 151 occupies the most forward position, the cross-sectional area of the first oil passage 144 is minimum. The minimum cross-sectional area of the first oil passage 144 is, for example, about half the maximum cross-sectional area of the first oil passage 144. Thus, the first valve 148 is structured as a flow rate control valve.

As a control fluid to be supplied to the pressure chamber 153 of the first valve 148, the working fluid in the refrigeration cycle apparatus 400 A is used. The use of the working fluid as a power source allows some leakage of the working fluid from the pressure chamber 153 to the first oil passage 144. Therefore, tight sealing is not required.

As shown in FIG. 12 and FIG. 13A, in the present embodiment, the first vane groove 42*a* is closed by the bearing member 42 and the intermediate plate 43. Therefore, the oil is supplied to the oil chamber 142 only through the first oil passage 144. As an oil passage for discharging the oil in the oil chamber 142 to the oil reservoir 25, the second oil passage 146 is provided. The second oil passage 146 communicates the oil chamber 142 with the oil reservoir 25 by a route different from the first oil passage 144. The second oil passage 146 is provided with the second valve 149.

The second valve 149 has a valve body 155, a spring 156, and an accommodation space 157. The valve body 155 can occupy the positions for closing and opening the second oil passage 146. The spring 156 is disposed in the accommodation space 157. The accommodation space 157 may communicate with the oil reservoir 25 so that the valve body 155 can move smoothly. When the oil in the oil chamber 142 is discharged to the oil reservoir 25, the valve body 155 is pushed by the oil and opens the second oil passage 146. Conversely, when the oil in the oil reservoir 25 is supplied to the oil chamber 142, the valve body 155 is subjected to an elastic force from the spring 156 and closes the second oil passage 146. In this way, the direction of the flow of the oil in the second oil passage 146 is limited substantially only to the direction from the oil chamber 142 to the oil reservoir 25 by the second valve 149. That is, the second valve 149 is structured as a direction control valve. The phrase "is limited substantially to . . . " is not intended to exclude completely an unavoidable slight flow.

Even if the second oil passage 146 and the second valve 149 are omitted, the ratio ($P_2/P_1$) can be adjusted, and therefore the variable vane mechanism 130 can work properly. When the oil in the oil chamber 142 is discharged to the oil reservoir 25, the first vane 48 is strongly pressed by the first piston 46. Therefore, even if the outflow resistance of the first oil passage 144 is high to some extent, the oil is discharged without any problem. However, such a high outflow resistance increases pressure loss. Furthermore, the valve body 151 of the first valve 148 flutters from side to side, which makes it difficult to set an intended confined volume.

In contrast, when the second oil passage 146 is provided, the oil in the oil chamber 142 is discharged to the oil reservoir 25 through both the first oil passage 144 and the second oil passage 146. In particular, since the oil is discharged relatively freely to the oil reservoir 25 through the second oil passage 146, an increase in the power recovery efficiency can be expected. Furthermore, since the second valve 149 as a direction control valve is provided in the second oil passage 146, it is possible to prevent the oil in the oil reservoir 25 from being supplied to the oil chamber 142 through the second oil passage 146. As a result, the rate of oil supply to the oil chamber 142 can be controlled precisely, and thus the confined volume can be adjusted more easily.

The oil chamber may be formed outside the first vane groove 42*a* on the condition that the oil can flow freely therebetween. For example, the oil chamber may be formed immediately behind the first vane groove 42*a*. Furthermore, the first valve 148 may be provided at the end portion of the first oil passage 144. The second valve 149 may be provided at the end portion of the second oil passage 146.

In the operation mode (first mode) shown in FIG. 14A, the pressure chamber 153 is filled with the low-pressure working fluid, and thus the first valve 148 is fully opened. When the first valve 148 is fully opened, the flow resistance of the first oil passage 144 is low. Therefore, the oil in the oil reservoir 25 can be supplied to the oil chamber 142 smoothly. As a result, a load enough to maintain the contact between the first vane 48 and the first piston 46 is applied continuously to the rear end surface of the first vane 48. The first vane 48 can follow the movement of the first piston 46, and thus the contact state between the first vane 48 and the first piston 46 is always maintained.

On the other hand, in the operation mode (second mode) shown in FIG. 14B, the pressure chamber 153 is filled with the high-pressure or intermediate-pressure working fluid, and thus the opening of the first valve 148 is reduced. Specifically, the valve body 151 moves to the position where the force applied to the valve body 151 by the working fluid filled in the pressure chamber 153 and by the spring 152 and the force applied to the valve body 151 by the oil in the first oil passage 144 are balanced with each other. Then, the cross-sectional area of the first oil passage 144 becomes smaller than that in the first mode (FIG. 14A). When the cross-sectional area of the first oil passage 144 becomes smaller, a rapid flow of the oil into the oil chamber 142 can be prevented. Then, the flow of the oil into the oil chamber 142 cannot catch up with the downward moving speed of the first vane 48, and the first vane 48 is spaced from the first piston 46 during the passage of a predetermined period $P_2$ from the moment when the first piston 46 occupies the top dead center. During this period, the high-pressure working fluid a continues to flow from the first suction space 55*a* into the first discharge space 55*b*. At the moment when the first vane 48 again comes into contact with the first piston 46 after the passage of the period $P_2$, the expansion chamber is formed by the first discharge space 55*b*, the through-hole 43*a*, and the second suction space 56*a*, and thus the working fluid begins to expand.

When the pressure in the pressure chamber 153 is changed, the position of the valve body 151 changes, and thus the flow rate of the oil flowing into the oil chamber 142 changes. The length of the period $P_2$ changes accordingly. The higher the pressure in the pressure chamber 153 is, the smaller the opening of the first valve 148 becomes, in other words, the smaller the cross-sectional area of the first oil passage 144 becomes, which makes the flow of the oil into the oil chamber less easily. Then, the period $P_1$ in which the first vane 48 is in contact with the first piston 46 becomes progressively shorter while the period $P_2$ becomes progressively longer, and the confined volume of the expansion chamber increases. In this way, the confined volume can be adjusted by adjusting the pressure in the pressure chamber 153. In other words, the suction volume of the expansion mechanism 3 can be adjusted freely.

Since the pipe 105 in the pressure adjustment circuit 110 is connected to the pressure supply passage 147 of the variable vane mechanism 130, the pressure in the pressure chamber 153 can be adjusted by the throttle valve 104 in the pressure adjustment circuit 110. That is, the opening of the first valve 148 can be controlled by adjusting the opening of the throttle valve 104. When the opening of the throttle valve 104 is increased, the pressure in the pressure chamber 153 increases, and the opening of the first valve 148 decreases. As a result, the confined volume increases. When the opening of the throttle valve 104 is reduced, the pressure in the pressure chamber 153 decreases, and the opening of the first valve 148 increases. As a result, the confined volume decreases.

The pressure in the pressure chamber 153 can be changed between the high pressure and the low pressure of the refrigeration cycle by adjusting the opening of the throttle valve 104, as in the first embodiment.

Next, the operating principle of the expansion mechanism 3 will be described. As shown in Steps $A_3$ to $D_3$ in FIG. 15, when the confined volume is minimum, the expansion mechanism 3 operates on the same principle as that described in the first embodiment with reference to FIG. 5.

Figure 15:
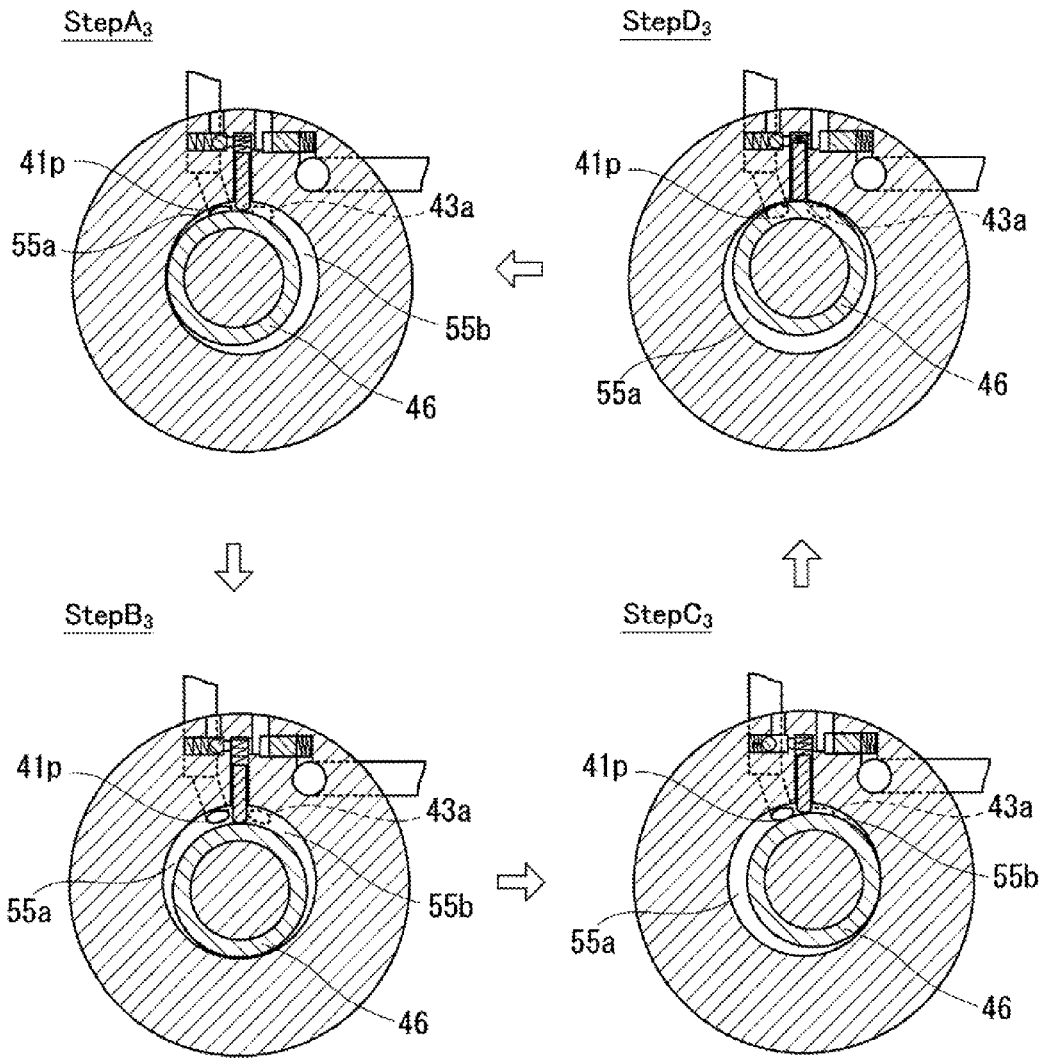
FIG. 15 is a diagram showing the operating principle of an expansion mechanism at the minimum confined volume.

Next, the operating principle of the expansion mechanism 3 at a larger confined volume than in FIG. 15 will be described with reference to FIG. 16.

Figure 16:
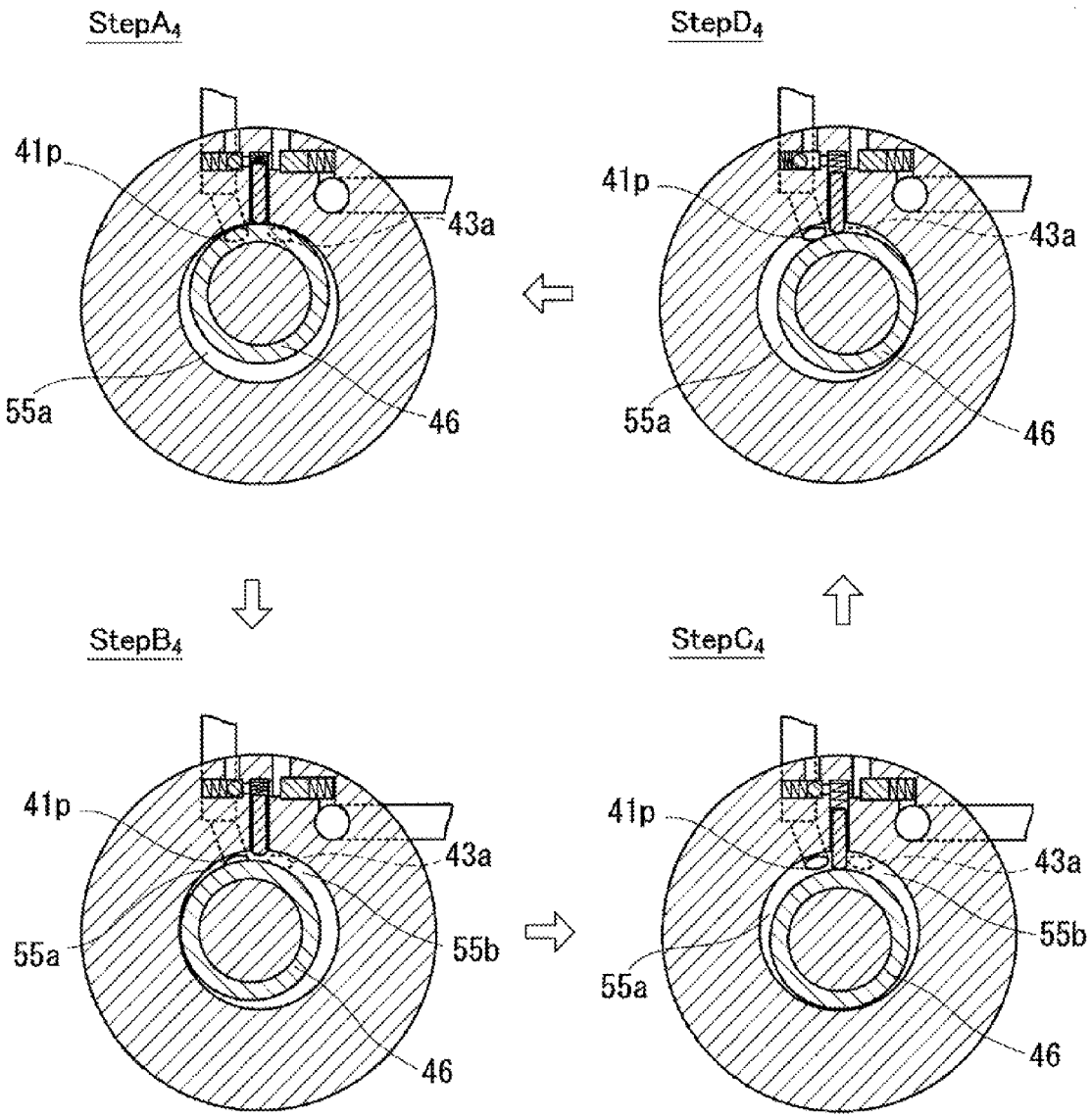
FIG. 16 is a diagram showing the operating principle of the expansion mechanism at a larger confined volume than in FIG. 15.

First, Step $A_1$ in FIG. 16 shows a state in which the first piston 46 rotates 360 degrees and the first suction space 55*a* is filled with a high-pressure working fluid. Next, as shown in Step $B_4$ in FIG. 16, when the first piston 46 rotates in a counterclockwise direction, it is spaced from the first vane 48. This is because the movement of the first vane 48 is restricted by the variable vane mechanism 130 from the moment when the first piston 46 occupies the top dead center. When the first piston 46 is spaced from the first vane 48, a flow path is formed from the first suction space 55*a* to the first discharge space 55*b*, and thus the high-pressure working fluid flows directly from the first discharge space 55*a* into the first discharge space 55*b*. The high-pressure working fluid also flows into the second suction space 56*a* that communicates with the first discharge space 55*b*. That is, the working fluid does not expand during the period $P_2$ in which the first piston 46 is spaced from the first vane 48, and the suction process continues.

Next, as shown in Step $C_4$ in FIG. 16, when the first piston 46 further rotates and comes close to the bottom dead center, the first vane 48 catches up with the first piston 46 and again comes into contact with the first piston 46. The first suction space 55*a* and the first discharge space 55*b* are separated from each other by the first vane 48, and the flow of the working fluid from the first suction space 55*a* to the first discharge space 55*b* is interrupted. The working fluid begins to expand from the point in time when the first vane 48 and the first piston 46 again come into contact with each other.

As shown in Step $D_4$ in FIG. 16, when the first piston 46 further rotates, the volumetric capacity of the first discharge space 55*b* decreases gradually, and the working fluid moves to the second suction space 56*a* while expanding. The operations in Steps $A_4$ to $D_4$ in FIG. 6 are repeated in this manner.

Figure 17A:
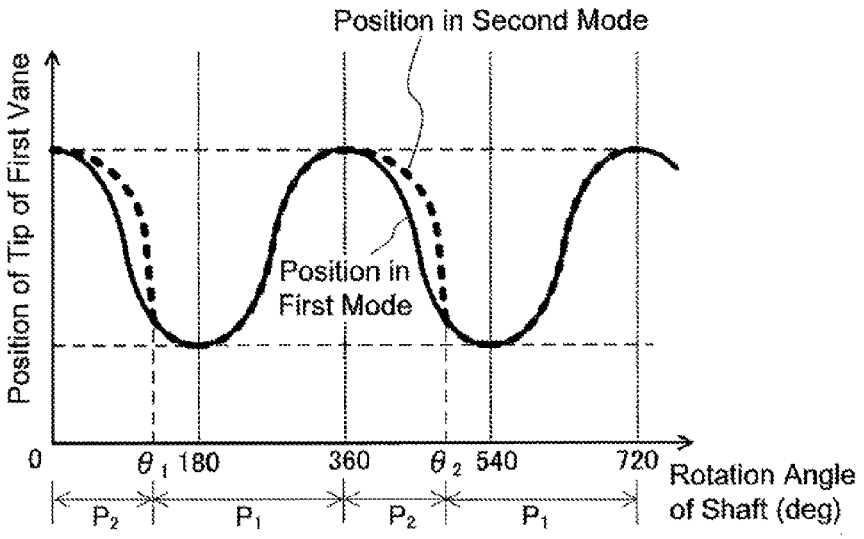
FIG. 17A is a graph showing the position of the tip of a first vane with respect to the rotation angle of a shaft.
Figure 17B:
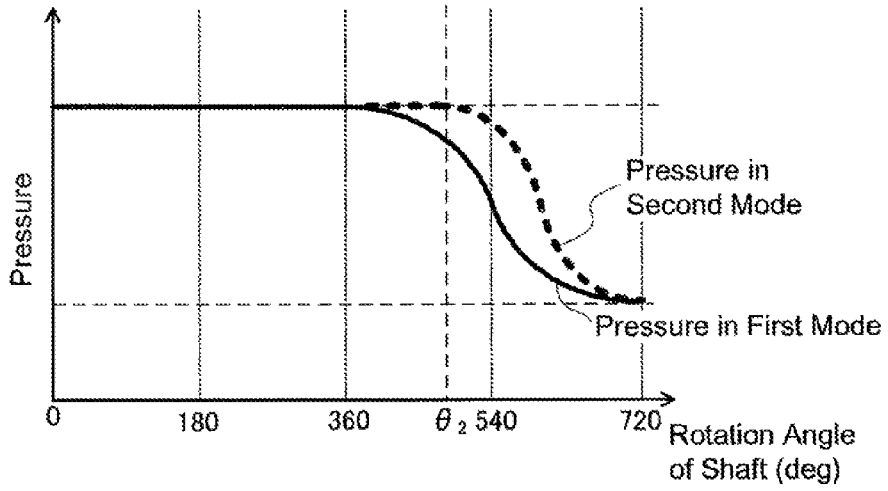
FIG. 17B is a graph showing the pressure of a working fluid with respect to the rotation angle of the shaft.
Figure 17C:
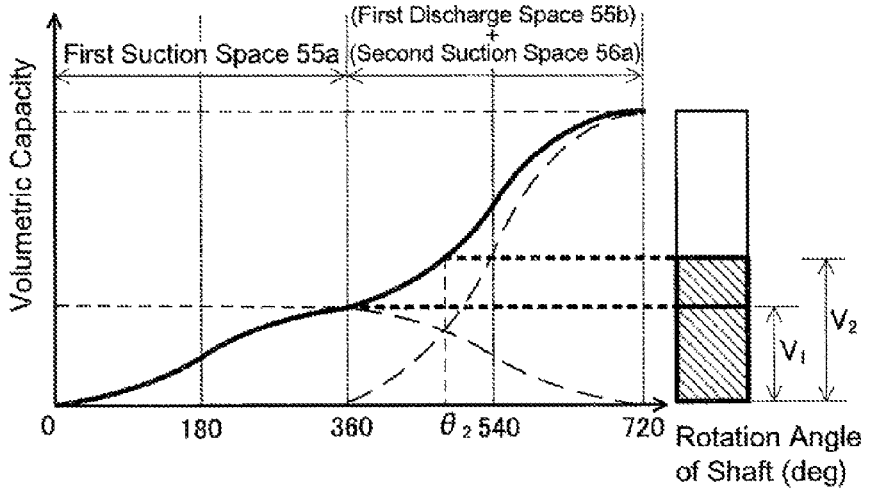
FIG. 17C is a graph showing the volumetric capacity of a working chamber with respect to the rotation angle of the shaft.

FIG. 17A, FIG. 17B, and FIG. 17C are graphs showing the position of the tip of the first vane, the pressure of the working fluid drawn into the expansion mechanism, and the volumetric capacity of the working chamber, respectively. In each of these graphs, the horizontal axis represents the rotation angle of the shaft 5 obtained when the angle at the moment the first piston 46 occupies the top dead center is defined as a reference angle (of 0 degree).

The position of the tip of the first vane 48 shown in the vertical axis in FIG. 17A corresponds to the distance from the rotational axis of the shaft 5 to the tip of the first vane 48. The solid line shows the position of the tip of the first vane 48 in the first mode. The dashed line shows the position of the tip of the first vane 48 in the second mode. In the second mode, the first vane 48 is detached from the first piston 46 at angles of 0 degree and 360 degrees (top dead center), and again comes into contact with the first piston 46 at angles of $\theta_1$ and $\theta_2$ slightly less than the angles of 180 degrees and 540 degrees (bottom dead center).

Also in FIG. 17B, the solid line corresponds to the first mode, and the dashed line corresponds to the second mode, respectively. In the first mode (solid line), the working fluid begins to be drawn into the expansion mechanism at the reference angle, and expands when the rotation angle is in the range of 360 to 720 degrees. On the other hand, in the second mode (dashed line), the working fluid expands when the rotation angle is in the range of the angle $\theta_2$, which is larger than 360 degrees, to 720 degrees.

The volumetric capacity of the working chamber shown in the vertical axis in FIG. 17C corresponds to the volumetric capacity of the first suction space 55*a* in the range of 0 to 360 degrees, and to the total volumetric capacity of the first discharge space 55*b* and the second suction space 56*a* in the range of 360 to 720 degrees. In the first mode, the suction process is completed at 360 degrees, and the expansion process is performed in the range of 360 to 720 degrees. On the other hand, in the second mode, the expansion process is performed in the range of the angle $\theta_2$, which is larger than 360 degrees, to 720 degrees. The total volumetric capacity (confined volume) $V_2$ of the first discharge space 55*b* and the second suction space 56*a* at the start of the expansion process in the second mode is larger than the total volumetric capacity (confined volume) $V_1$ in the first mode.

The difference in the suction volume $\Delta V$ between the first mode and the second mode is expressed as $(V_2-V_1)$ per cycle including the suction process, the expansion process, and the discharge process. This volume difference $\Delta V$ increases or decreases according to the length of the period $P_2$ (in other words, the ratio $(P_2/P_1)$). The length of the period $P_2$ varies depending on the pressure in the pressure chamber 153 of the variable vane mechanism 130. The range of the ratio $(P_2/P_1)$ is not particularly limited. For example, the ratio is $0 \leq (P_2/P_1) \leq 1$. This means that the period $P_2$ falls within the period in which the rotation angle of the shaft 5 is in the range of 0 to 180 degrees, if the rotation angle at the moment when the first piston 46 occupies the top dead center is defined as 0 degree. In the present embodiment, the moment when the first piston 46 occupies the top dead center is the starting point of the period $P_2$.

As described above, with the expansion mechanism 3 including the variable vane mechanism 130, the confined volume of the expansion chamber can be changed. Therefore, the volume of the working fluid to be drawn into the expansion mechanism 3 during one rotation of the shaft can be changed.

(Modification of Fourth Embodiment)

Figure 18:
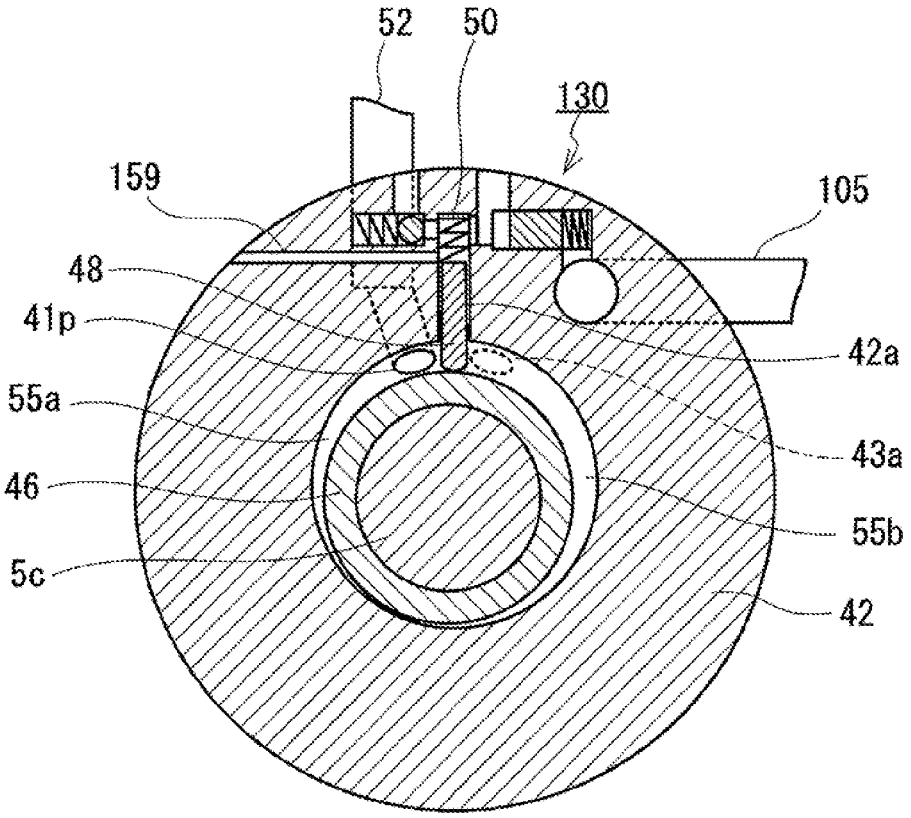
FIG. 18 is a transverse cross-sectional view of a modified variable vane mechanism of the fourth embodiment.

FIG. 18 is a transverse cross-sectional view of a modification of the fourth embodiment. According to this modification, the variable vane mechanism 130 further includes an acceleration port 159 for assisting the first vane 48 in moving downward (in the direction approaching the rotation axis of the shaft 5) in the second mode. One end of the acceleration port 159 opens into the first vane groove 42*a* at a predetermined position along the longitudinal direction of the first vane groove 42*a*. The other end of the acceleration port 159 opens into the oil reservoir 25. When the rear end surface of the first vane 48 passes the position of the one end of the acceleration port 159 in the process where the first vane 48 is pushed out of the first vane groove 42*a* by the load applied by the oil and the first spring 50, the oil in the oil reservoir 25 can flow into the first vane groove 42*a* through the acceleration port 159.

That is, with this acceleration port 159, even in the case where the cross-sectional area of the first oil passage 144 (see FIG. 14A) is set small, when the first vane 48 projects from the first vane groove 42*a* to some extent, the resistance of the oil flowing into the portion (oil chamber 142) behind the first vane groove 42*a* drops sharply. Then, the first vane 48 is pushed strongly toward the first piston 46, and again comes into contact with the first piston 46 immediately.

For example, in the case where the resistance of the oil flowing into the portion (oil chamber 142) behind the first vane groove 42*a* is very high, the first vane 48 could be kept away from the first piston 46 even if the first piston 46 reaches the bottom dead center. To put it more simply, the period $P_2$ could continue even after the rotation angle exceeds 180 degrees. In contrast, when the acceleration port 159 is provided, it is possible to ensure that the first vane 48 and the first piston 46 again come into contact with each other before the first piston 46 reaches the bottom dead center. As a result, a sufficiently high ratio of expansion can be obtained, and thus an increase in the power recovery efficiency can be expected.

(Fifth Embodiment)

Figure 19:
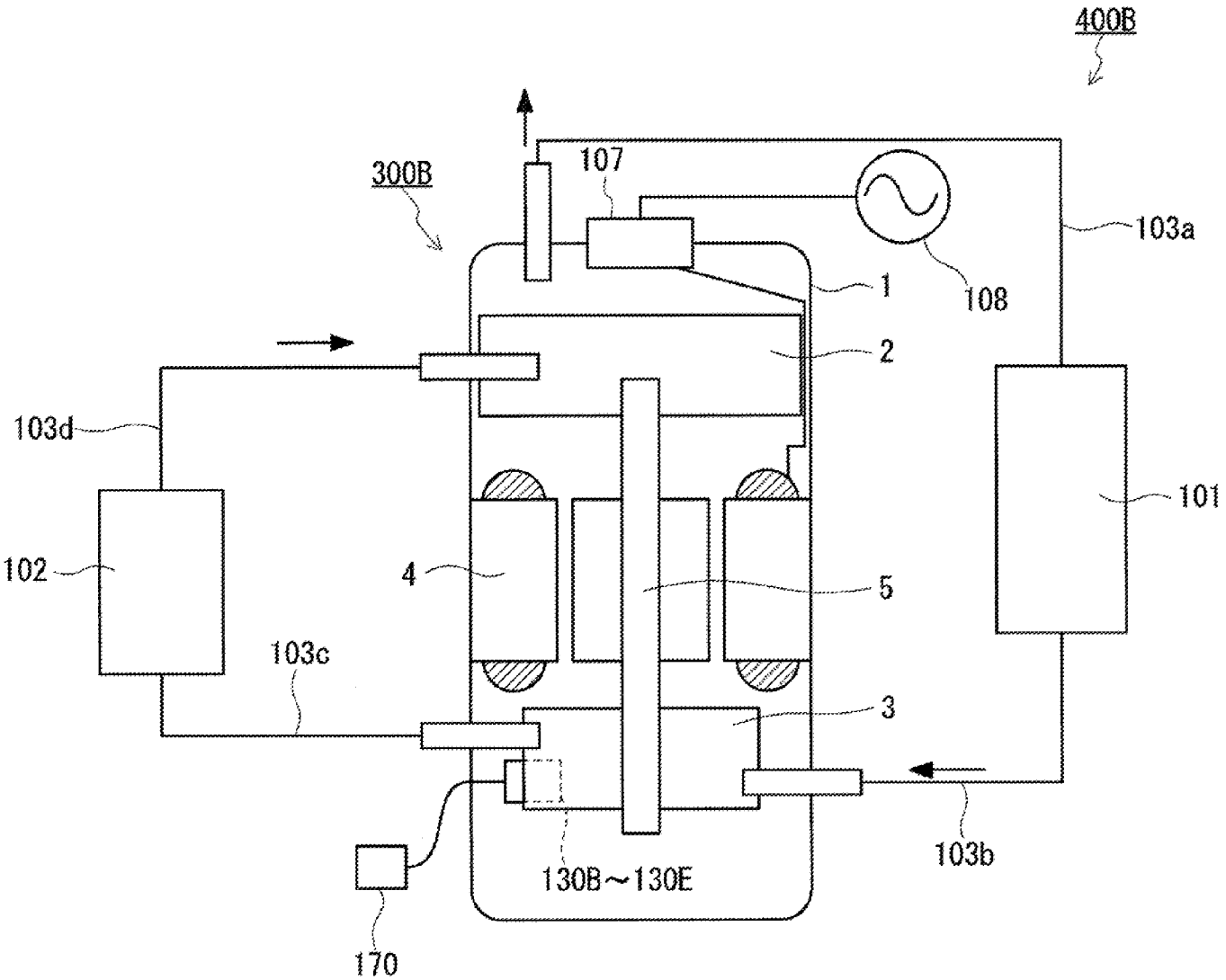
FIG. 19 is a configuration diagram showing a refrigeration cycle apparatus according to a fifth embodiment of the present invention.

FIG. 19 is a configuration diagram of a refrigeration cycle apparatus in which a variable vane mechanism for controlling the movement of the first vane by an electrical method is used. This refrigeration cycle apparatus 400B has an expander-integrated compressor 300B. The expansion mechanism 3 in the expander-integrated compressor 300B is provided with a variable vane mechanism 130B, (130C, 130D, or 130E) connected to an external controller 170. The operation of the variable vane mechanism 130B is controlled by the external controller 170. The refrigeration cycle apparatus 400B has an advantage in that the pressure supply circuit 110 shown in FIG. 11 can be omitted. In addition, since the variable vane mechanism 130B controls the movement of the first vane 48 by an electrical method, the confined volume can be optimized easily.

The variable vane mechanisms 130B to 130E for controlling the movement of the first vane 48 by an electrical method will be described below. In the present embodiment, the rear portion of the first vane groove 42*a* (where the first spring 50 is placed) opens into the oil reservoir 25, and the oil in the oil reservoir 25 can flow freely into the rear portion of the first vane groove 42*a*.

Figure 20:
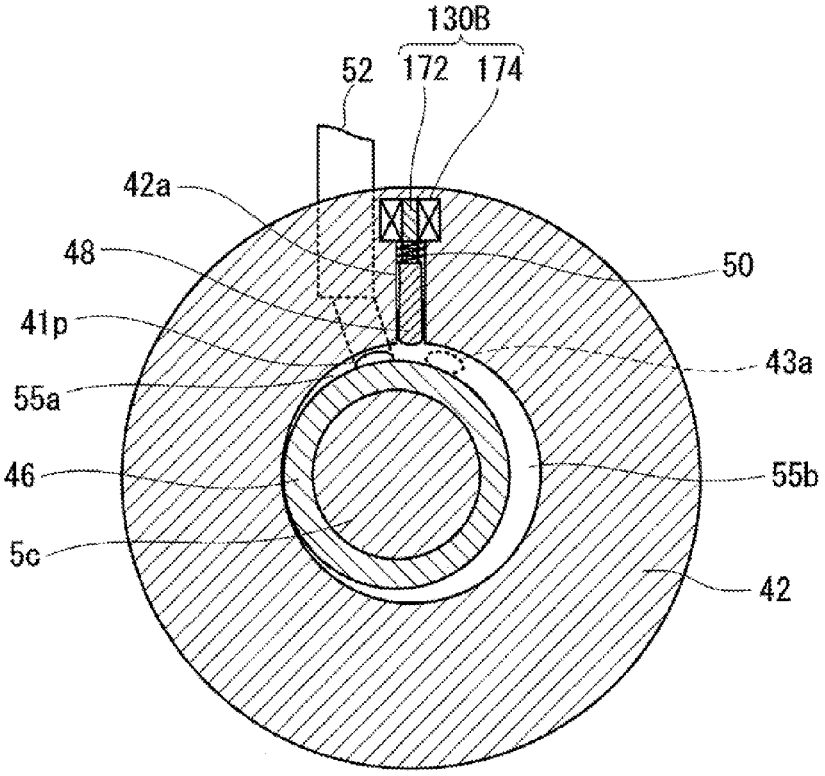
FIG. 20 is a partially enlarged view of a variable vane mechanism using an electromagnetic force to brake the first vane.

The variable vane mechanism 130B shown in FIG. 20 is constituted by an electromagnet having a coil 174 and an iron core 172. The coil 174 applies an electromagnetic force to the first vane 48 to prevent the first vane 48 from following the movement of the first piston 46. That is, when the coil 174 is energized, the iron core 172 serves as a magnet to attract the first vane 48. Thereby, the first vane 48 can be prevented from following the movement of the first piston 46. Typically, the first vane 48 is made of an iron-based metal such as cast iron or carbon steel, and the iron-based metal can be attracted by a magnet. Therefore, the electromagnet can restrict the movement of the first vane 48.

The coil 174 is placed behind the first vane groove 42*a*. The iron core 172 penetrates the coil 174, and the tip of the iron core 172 projects into the first vane groove 42*a*. The length of the iron core 172 with respect to the longitudinal direction of the first vane groove 42*a* is determined so that the first vane 48 comes into contact with the iron core 172 when the first vane 48 is pressed most deeply into the first vane groove 42*a*. The timing of energizing the coil 172 can be controlled by the external controller 170 (see FIG. 19). The supply of electric current to the coil 172 is started immediately before the first piston 46 reaches the top dead center. The length of the period $P_2$ in which the first vane 48 is spaced from the first piston 46, in other words, the confined volume of the expansion mechanism, can be adjusted by controlling the timing of starting and stopping the supply of electric current.

Figure 21:
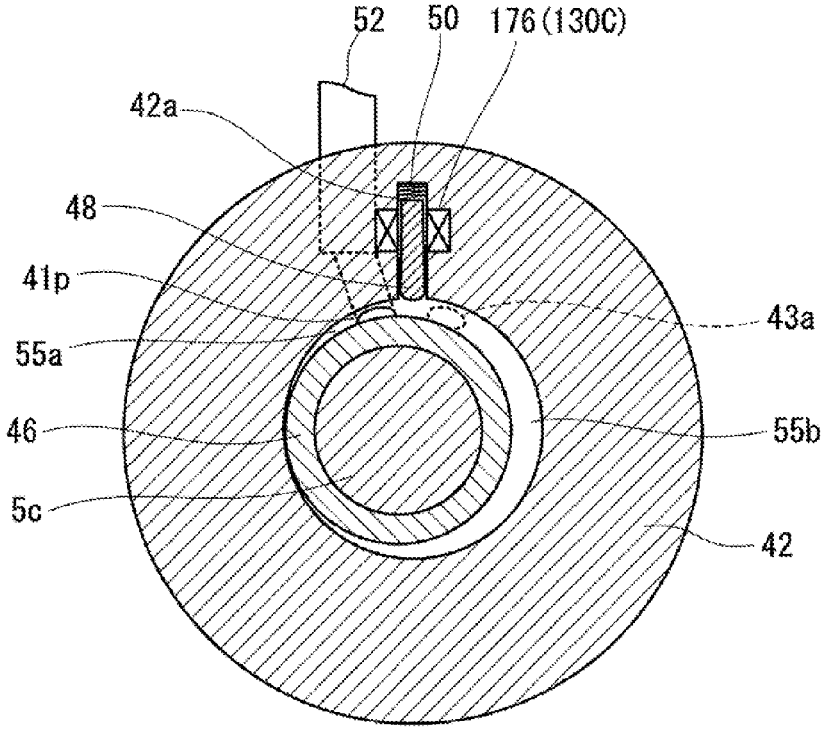
FIG. 21 is a partially enlarged view of another example of a variable vane mechanism using an electromagnetic force to brake the first vane.

The variable vane mechanism 130C shown in FIG. 21 is constituted by a coil 176 disposed around the first vane 48. When the coil 176 is energized, the first vane 48 is subjected to a force that draws it into the coil 176. That is, the first vane 48 itself acts as a plunger of a solenoid. As in the example shown in FIG. 20, the timing of energizing the coil 176 can be controlled by the external controller 170, and thereby, the confined volume of the expansion mechanism 3 can be adjusted. Since the coil 176 is disposed around the first vane 48, such a problem as a shortage of space is less likely to occur.

In the fourth embodiment, the movement of the first vane 48 merely slows down near the top dead center, but in the examples shown in FIG. 20 and FIG. 21, the first vane 48 can be locked (or the movement thereof can be stopped temporarily) near the top dead center. When the first vane 48 is locked momentarily, the inflow cross-sectional area (width of the space between the first piston 46 and the first vane 48) increases, and thus pressure loss can be reduced.

Figure 22:
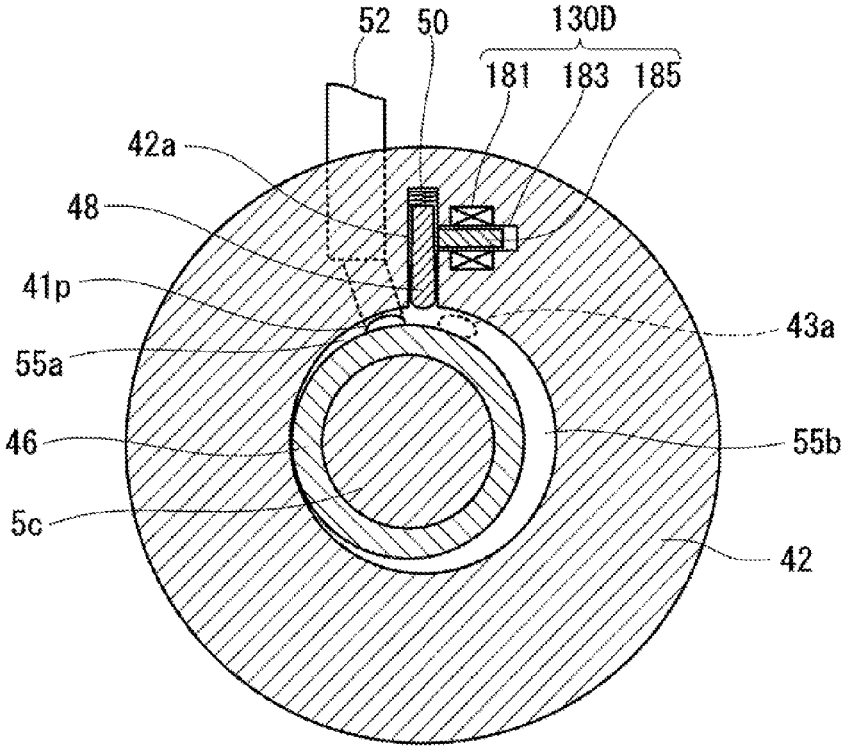
FIG. 22 is a partially enlarged view of a variable vane mechanism for applying a load to brake the first vane.

The variable vane mechanism 130D shown in FIG. 22 is constituted by an electric actuator for applying a load to the first vane 48 to increase the sliding friction between the first vane groove 42*a* and the first vane 48. Specifically, the variable vane mechanism 130D is constituted by a solenoid having a coil 181 and a plunger 185.

A groove 183 extending at an approximately right angle to the longitudinal direction of the first vane groove 42*a* is formed in the first cylinder 42. The plunger 185 is disposed in this groove 183. The coil 181 is disposed around the plunger 185. The head of the plunger 185 faces the side surface of the first vane 48. When the plunger 185 is retracted to the position where it does not interfere with the first vane 48, the movement of the first vane 48 is not hindered by the variable vane mechanism 130D (in the first mode). On the other hand, when the plunger 185 is pushed out of the groove 183 to energize the coil 181, the head of the plunger 185 hits the first vane 48 at a right angle. Thereby, the side surface of the first vane 48 is subjected to a load in the direction toward the inner wall of the first vane groove 42*a*, and thus the first vane 48 becomes difficult to move along the longitudinal direction of the first vane groove 42*a*.

Figure 23:
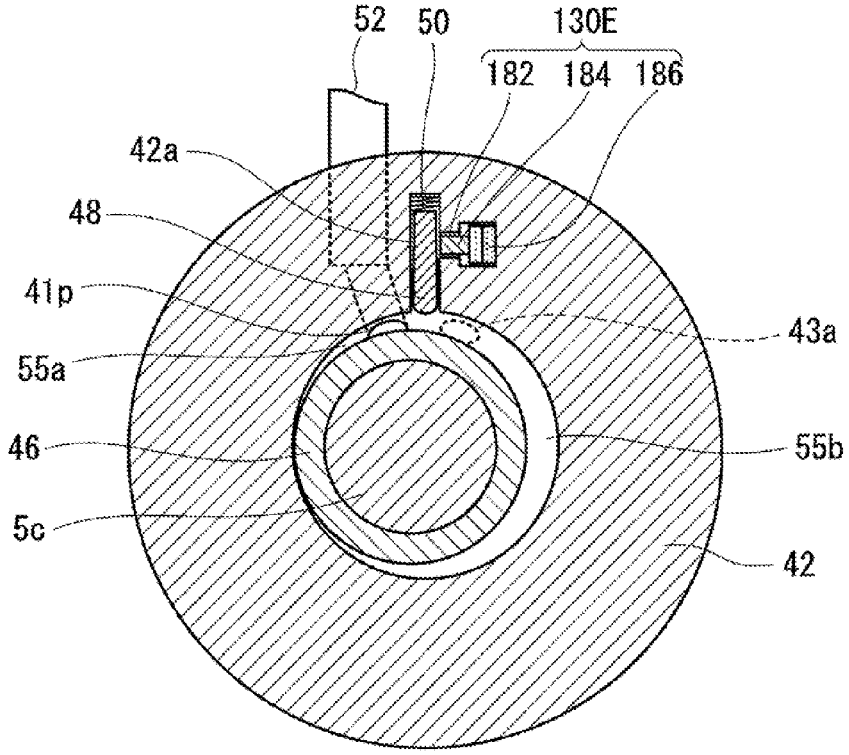
FIG. 23 is a partially enlarged view of another example of a variable vane mechanism for applying a load to brake the first vane.

The variable vane mechanism 130E shown in FIG. 23 is the same as the variable vane mechanism 130D described with reference to FIG. 22 in that it is constituted by an electric actuator for applying a load laterally to the first vane 48. Specifically, the variable vane mechanism 130E is constituted by a piezoelectric actuator having a piezoelectric element 186 and a plunger 184 connected to the piezoelectric element 186.

A groove 182 is formed in the first cylinder 42 so as to communicate with a midpoint of the first vane groove 42*a* with respect to its longitudinal direction. The plunger 184 and the piezoelectric element 186 are disposed in the groove 182 so that the head of the plunger 184 faces the first vane 48. The rear end of the plunger 184 is fixed to the piezoelectric element 186. The piezoelectric element 186 and the plunger 184 are coupled together so that the displacement of the piezoelectric element 186 is transmitted to the plunger 184. The action of the plunger 184 is the same as described with reference to FIG. 22, except that the piezoelectric element is used instead of the coil.

In the examples shown in FIG. 22 and FIG. 23, the variable vane mechanisms 130D and 130E are built in the first cylinder 42. The variable vane mechanisms 130D and 130E may, however, be built in the bearing member 41 or the intermediate plate 43. They may be provided across the bearing member 41, the first cylinder 42, and the intermediate plate 43.

Figure 24:
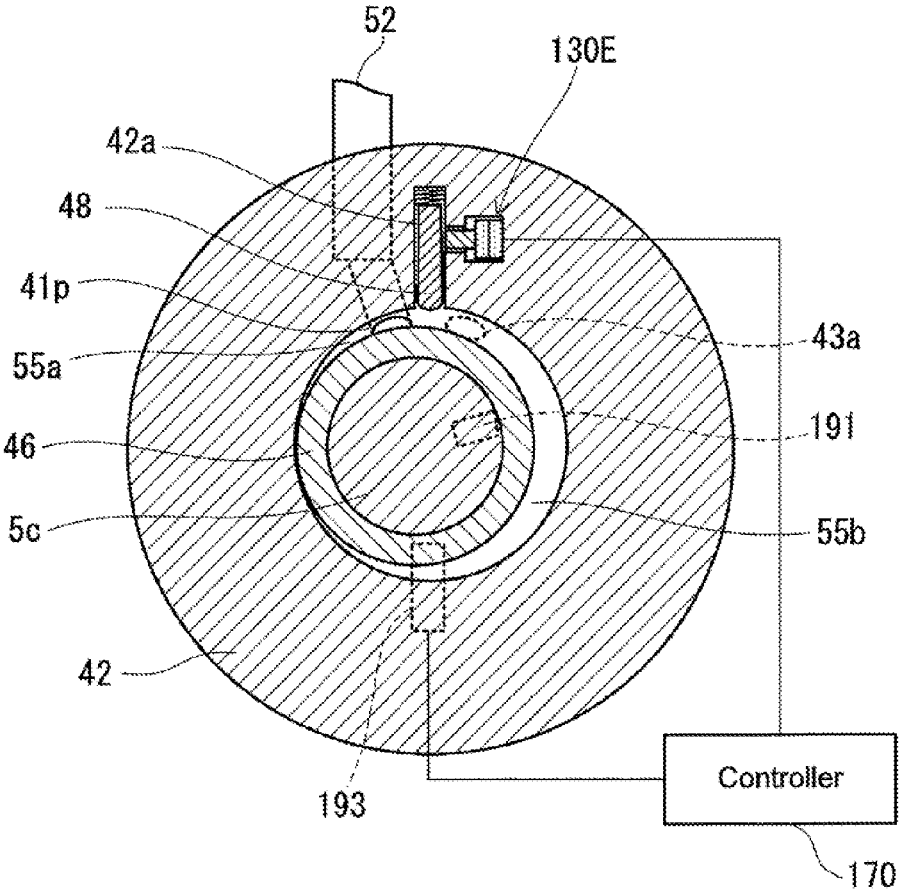
FIG. 24 is a diagram showing how to control an electric actuator.

Electric current is supplied to each of the variable vane mechanisms shown in FIGS. 20 to 23 at an appropriate timing. Specifically, the supply of electric current to the coil or the piezoelectric element is controlled based on the rotation angle of the shaft 5. In order to detect the rotation angle of the shaft 5, a rotor 191 that rotates with the shaft 5 and a position sensor 193 that can detect the passing of the rotor 191 may be provided, as shown in FIG. 24. For example, the rotor 191 is placed 180-degree opposite to the eccentric direction of the eccentric portion 5*c* of the shaft 5 (or to coincide with the eccentric direction). Furthermore, the position sensor 193 is placed at a position corresponding to the bottom dead center of the first piston 46.

Figure 25:
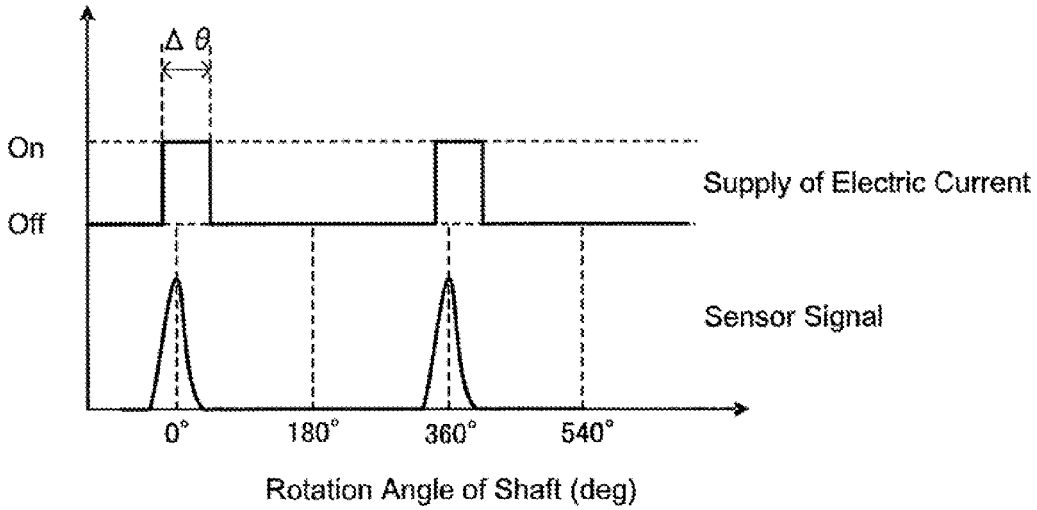
FIG. 25 is a timing diagram showing how to control the electric actuator.

With the above configuration, as shown in FIG. 25, a sensor signal is transmitted from the position sensor 193 to the external controller 170 when the first piston 46 reaches the top dead center (or the bottom dead center). The external controller 170 can supply electric current to the coil or the piezoelectric element accurately upon receiving the sensor signal from the position sensor 193. Electric current may be supplied shortly before the first piston 46 reaches the top dead center (=0 degree). This ensures that the movement of the first vane 48 is stopped or retarded. The period of the electric current supply $\Delta\theta$ may be controlled so that a desired confined volume can be obtained.

The sensor for detecting the rotation angle (reference position) of the shaft 5 may be provided at a position other than the expansion mechanism 3. For example, it may be provided in the compression mechanism 2.

Sixth Embodiment

Figure 26:
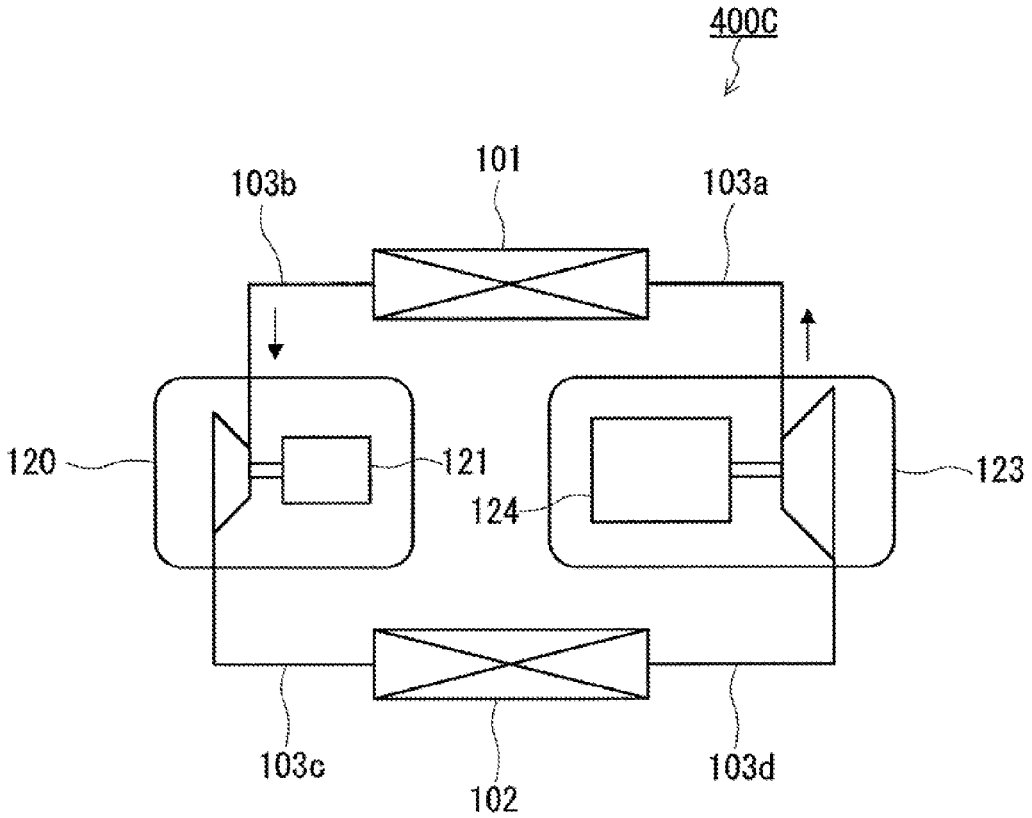
FIG. 26 is a configuration diagram showing a refrigeration cycle apparatus according to a sixth embodiment of the present invention.

The present invention can be applied also to a two-stage rotary expander as a single unit. FIG. 26 shows a power recovery type refrigeration cycle apparatus 400C using such a two-stage rotary expander. The refrigeration cycle apparatus 400C includes a compressor 123, a radiator 101, an expander 120, and an evaporator 102. As the expander 120, a two-stage rotary expander having a structure in which the compression mechanism 2 is removed from each of the expander-integrated compressors described above can be used. The expansion energy of the working fluid is converted into electrical energy by a power generator 121 of the expander 120, and the obtained electrical energy is supplied to a motor 124 of the compressor 123.

The rotational speed of the compressor 123 can be controlled by the motor 124, and the rotational speed of the expander 120 can be controlled by the power generator 121. Therefore, this refrigeration cycle apparatus 400C is essentially free from the constraint of constant density ratio. However, if the two-stage rotary expander provided with the variable vane mechanism is employed, the following advantageous effect can be obtained.

Figure 27:
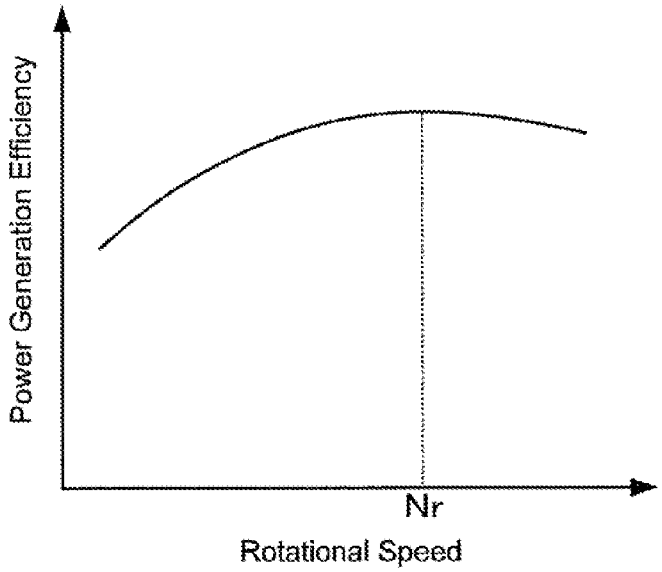
FIG. 27 is a graph showing the relationship between power generator efficiency and rotation speed.

FIG. 27 shows the efficiency curve of a typical power generator. The power generator is designed to achieve the highest power generation efficiency at a predetermined rated rotational speed Nr (for example, 60 Hz). Therefore, the power generation efficiency decreases as the difference between the actual rotational speed and the rated rotational speed increases. That is, it is desirable that the rotational speed of the power generator be as close to the rated rotational speed Nr as possible even if it can be controlled by an inverter. However, the amount and density of a working fluid flowing through the refrigeration cycle apparatus vary, and therefore it is difficult to maintain the rotational speed of the power generator close to the rated rotational speed Nr if a conventional expander is used. In contrast, if the two-stage rotary expander provided with the variable vane mechanism is used, the density ratio can be changed while the rated rotational speed Nr is maintained. Therefore, more efficient power recovery can be expected.

INDUSTRIAL APPLICABILITY

The present invention is suitably applicable to refrigeration cycle apparatuses used for air conditioners and water heaters. The applications of the present invention are not limited to these, and the present invention can be applied to a wide variety of other apparatuses such as a Rankine cycle apparatus.

The invention claimed is:

1. A two-stage rotary expander comprising:

a first cylinder;

a first piston disposed rotatably in the first cylinder;

a second cylinder disposed concentrically with the first cylinder;

a second piston disposed rotatably in the second cylinder;

a shaft on which the first piston and the second piston are mounted;

a first vane, disposed slidably in a first vane groove formed in the first cylinder, for partitioning a space between the first cylinder and the first piston into a first suction space and a first discharge space;

a second vane, disposed slidably in a second vane groove formed in the second cylinder, for partitioning a space between the second cylinder and the second piston into a second suction space and a second discharge space;

an intermediate plate for separating the first cylinder from the second cylinder, the intermediate plate having a through-hole that communicates the first discharge space with the second suction space so as to form one expansion chamber; and a variable vane mechanism comprising a stopper for changing a range of the movement of the first vane, the variable vane mechanism being configured to control movement of the first vane so that a ratio of a period $P_2$ to a period $P_1$ ($P_2/P_1$) can be adjusted, where $P_1$ denotes the period during which the first vane is in contact with the first piston in the course of one rotation of the shaft, and $P_2$ denotes the period during which the first vane is spaced from the first piston in the course of one rotation of the shaft, wherein the stopper constantly engages the first vane, and there are more than two levels of the ratio ($P_2/P_1$) to be set by the variable vane mechanism.

2. The two-stage rotary expander according to claim 1, wherein the first vane is detached from the first piston in the course of expansion of a working fluid in the expansion chamber, so that a working fluid to be expanded is injected into the expansion chamber.

3. The two-stage rotary expander according to claim 1, the variable vane mechanism further includes an actuator for moving the stopper between a first position and a second position so as to change the range of the movement of the first vane continuously or in a stepwise manner, wherein the first vane is movable within a first range when the actuator is in the first position, the first vane is movable within a second range when the actuator is in the second position, and the second range is shorter than the first range.

4. The two-stage rotary expander according to claim 3, wherein the actuator is a fluid pressure actuator, and the fluid pressure actuator includes:

a main body that includes a portion working with the stopper, and determines, based on a pressure of a fluid, a position of the stopper with respect to a longitudinal direction of the first vane groove;

a pressure chamber in which the main body is placed; and a passage for supplying the fluid to the pressure chamber.

5. The two-stage rotary expander according to claim 4, wherein the main body includes a slider disposed slidably in the pressure chamber to partition the pressure chamber into sections, and a spring provided in one section of the pressure chamber partitioned by the slider, the stopper is integrated with or coupled to the slider, the passage is connected to the other section of the pressure chamber partitioned by the slider, and the position of the stopper with respect to the longitudinal direction of the first vane groove is determined based on a force applied to the slider by the fluid that has been supplied through the passage and a force applied to the slider by the spring.

6. The two-stage rotary expander according to claim 4, wherein the first vane has a recessed portion for receiving the stopper, the pressure chamber of the fluid pressure actuator is formed adjacent to the first vane groove, and one end of the stopper is fixed to the slider and the other end of the stopper is constantly inserted into the recessed portion so that the stopper extends from the pressure chamber to the first vane groove.

7. The two-stage rotary expander according to claim 3, wherein the actuator is an electric actuator, and the electric actuator and the stopper are coupled together so that the position of the stopper with respect to the longitudinal direction of the first vane groove changes when the electric actuator is driven.

8. The two-stage rotary expander according to claim 3, wherein the actuator is a fluid pressure actuator, the two-stage rotary expander further comprises a suction pipe and a pressure supply circuit configured to supply a working fluid, whose pressure is adjusted, to the fluid pressure actuator, the pressure supply circuit comprises a pressure supply pipe branching from the suction pipe and connected to the fluid pressure actuator, and a throttle valve provided on the pressure supply pipe, and the throttle valve is an opening-adjustable valve.

9. The two-stage rotary expander according to claim 8, further comprising a discharge pipe, wherein the pressure supply circuit further comprises a fine passage branching from a portion of the pressure supply pipe between the throttle valve and the variable vane mechanism and connected to the discharge pipe.

10. The two-stage rotary expander according to claim 9, wherein the fine passage comprises a capillary.

11. A two-stage rotary expander comprising:

a first cylinder;

a first piston disposed rotatably in the first cylinder;

a second cylinder disposed concentrically with the first cylinder;

a second piston disposed rotatably in the second cylinder;

a shaft on which the first piston and the second piston are mounted;

a first vane, disposed slidably in a first vane groove formed in the first cylinder, for partitioning a space between the first cylinder and the first piston into a first suction space and a first discharge space;

a second vane, disposed slidably in a second vane groove formed in the second cylinder, for partitioning a space between the second cylinder and the second piston into a second suction space and a second discharge space;

an intermediate plate for separating the first cylinder from the second cylinder, the intermediate plate having a through-hole that communicates the first discharge space with the second suction space so as to form one expansion chamber; and a variable vane mechanism configured to control movement of the first vane so that a ratio of a period $P_2$ to a period $P_1$ ($P_2/P_1$) can be adjusted, where $P_1$ denotes the period during which the first vane is in contact with the first piston in the course of one rotation of the shaft, and $P_2$, denotes the period during which the first vane is spaced from the first piston in the course of one rotation of the shaft, and an oil reservoir for storing oil for lubrication, wherein the variable vane mechanism controls the movement of the first vane so that a confined volume of the expansion chamber can be adjusted by changing the ratio ($P_2/P_1$), when a point in time when the first piston reaches a top dead center is a starting point of the period $P_2$, and the variable vane mechanism includes:

an oil chamber that communicates with the first vane groove so that the oil can be supplied to the first vane groove and the oil can be received from the first vane groove;

an oil passage, for supplying the oil in the oil reservoir to the oil chamber, and for discharging the oil in the oil chamber to the oil reservoir; and an opening-adjustable valve provided in the oil passage so that a flow resistance of the oil passage can be increased or decreased.

12. The two-stage rotary expander according to claim 11, wherein the variable vane mechanism is constructed to prevent the first vane from following movement of the first piston.

13. The two-stage rotary expander according to claim 11, wherein the oil passage includes a first oil passage provided with the opening-adjustable valve, and a second oil passage that communicates the oil chamber with the oil reservoir by a route different from the first oil passage, the variable vane mechanism further includes a second valve provided in the second oil passage, and a direction of flow of the oil in the second oil passage is limited substantially only to a direction from the oil chamber to the oil reservoir by the second valve.

14. The two-stage rotary expander according to claim 11, wherein the variable vane mechanism includes a coil for applying an electromagnetic force to the first vane to prevent the first vane from following the movement of the first piston, and a timing of supplying electric current to the coil can be controlled externally.

15. The two-stage rotary expander according to claim 14, wherein a supply of electric current to the coil is controlled based on a rotation angle of the shaft.

16. The two-stage rotary expander according to claim 11, wherein the variable vane mechanism includes an electric actuator for applying a load to the first vane to increase sliding friction between the first vane groove and the first vane, and driving of the electric actuator can be controlled externally.

17. The two-stage rotary expander according to claim 11, wherein the opening-adjustable valve is a valve whose opening is adjusted according to a pressure of a control fluid, the two-stage rotary expander further comprises a suction pipe and a pressure supply circuit configured to supply the control fluid, whose pressure is adjusted, to the opening-adjustable valve, the control fluid is a working fluid used in the two-stage rotary expander, the pressure supply circuit comprises a pressure supply pipe branching from the suction pipe and connected to the variable vane mechanism, and a throttle valve provided on the pressure supply pipe, and the throttle valve is an opening-adjustable valve.

18. The two-stage rotary expander according to claim 17, further comprising a discharge pipe, wherein the pressure supply circuit further comprises a fine passage branching from a portion of the pressure supply pipe between the throttle valve and the variable vane mechanism and connected to the discharge pipe.

19. The two-stage rotary expander according to claim 18, wherein the fine passage comprises a capillary.

* * * * *